US007978028B2

(12) United States Patent
Ishii

(10) Patent No.: US 7,978,028 B2
(45) Date of Patent: Jul. 12, 2011

(54) DUAL MODE GENERATING LINE COUPLED TO A DUAL MODE RING RESONATOR FILTER BY HALF THE LENGTH OF THE RING RESONATOR

(75) Inventor: Masatoshi Ishii, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 187 days.

(21) Appl. No.: 12/411,584

(22) Filed: Mar. 26, 2009

(65) Prior Publication Data

US 2009/0315647 A1 Dec. 24, 2009

(30) Foreign Application Priority Data

Jun. 18, 2008 (JP) ..... 2008-159092
Dec. 26, 2008 (JP) ..... 2008-332782

(51) Int. Cl.
*H01P 1/203* (2006.01)
*H01B 12/02* (2006.01)

(52) U.S. Cl. ..... 333/204; 333/219; 333/99 S

(58) Field of Classification Search ..... 333/204, 333/219, 99 S; 505/210
See application file for complete search history.

(56) References Cited

U.S. PATENT DOCUMENTS 5,400,002 A * 3/1995 Takahashi et al. ..... 333/204
2008/0297284 A1 * 12/2008 Ishii et al. ..... 333/212

FOREIGN PATENT DOCUMENTS

JP 09-139612 A 5/1997
JP 2000-209002 A 7/2000

* cited by examiner

*Primary Examiner* — Benny Lee
(74) *Attorney, Agent, or Firm* — Fujitsu Patent Center

(57) ABSTRACT

At a first coupling point on a ring resonator having a ring-shaped transmission line, an input feeder is electromagnetically coupled with the ring resonator. An output feeder is electromagnetically coupled with the ring resonator at a second coupling point on the ring resonator. A dual mode generating line is disposed in an inner area of the ring resonator. One end of the dual mode generating line is electromagnetically coupled with the ring resonator at a third coupling point on the ring resonator, and the other end is electromagnetically coupled with the ring resonator at a fourth coupling point on the ring resonator distant from the third coupling point by half of a transmission line length of the ring resonator.

7 Claims, 18 Drawing Sheets

DUAL MODE GENERATING LINE COUPLED TO A DUAL MODE RING RESONATOR FILTER BY HALF THE LENGTH OF THE RING RESONATOR

CROSS-REFERENCE TO RELATED APPLICATIONS

This application is based upon and claims the benefit of priority of the prior Japanese Patent Applications Nos. 2008-159092 and 2008-332782 filed on Jun. 18, 1008 and Dec. 26, 2008, respectively, the entire contents of which are incorporated herein by reference.

FIELD

The embodiments discussed herein are related to a dual mode filter including a ring-shaped transmission line.

BACKGROUND

High speed and high capacity transmission technologies are becoming essential due to recent spread and growth of mobile phones and other wireless communications. In order to realize high speed and high capacity communications, it is necessary to ensure a broad frequency band. A frequency band used by wireless communications is shifting to high frequencies. In such a high frequency band, filters for wireless communications are required to have filter characteristics capable of selectively passing only desired frequency components and steeply cutting other frequency components. A wireless communication instrument using high frequency components is required to be made compact and light.

As a filter used in a high frequency band, a filter is known which includes a ring resonator constituted of a ring-shaped transmission line. A resonance frequency of a ring resonator is specified by a transmission line length of the resonator. A resonance wavelength or an integer multiple thereof is equal to the electric line length of the ring resonator. In order to increase a space efficiency of a ring resonator, a structure has been proposed by which one ring resonator is resonated in two resonance modes (dual mode) to obtain steeper filter characteristics.

An input line and an output line are coupled with a ring resonator at two points separated from each other by a transmission line length corresponding to a quarter wavelength. By disposing a stub between two coupling points, resonance in dual mode is generated. Resonance in dual mode is also generated by disposing a distributed coupled line outside a ring resonator along a partial circumference of the ring resonator. This distributed coupled line is disposed running in parallel to the ring resonator at generally a middle point of a longer one of two transmission lines, both ends of which correspond to the two coupling points being coupled with the input and output lines.

The following are examples of related art of the present invention: Japanese Patent Laid-Open No. 9-139612, Japanese Patent Laid-Open No. 2000-209002.

SUMMARY OF THE INVENTION

According to an aspect of the invention, a dual mode filter includes a ring resonator having a ring-shaped transmission line, an input feeder electromagnetically coupled with the ring resonator at a first coupling point on the ring resonator, an output feeder electromagnetically coupled with the ring resonator at a second coupling point on the ring resonator different from the first coupling point, and a dual mode generating line disposed in an inner area of the ring resonator, one end of the dual mode generating line electromagnetically coupled with the ring resonator at a third coupling point on the ring resonator, and the other end electromagnetically coupled with the ring resonator at a fourth coupling point on the ring resonator distant from the third coupling point by half of a transmission line length of the ring resonator.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DETAILED DESCRIPTION OF PREFERRED EMBODIMENTS

Embodiments will now be described with reference to the accompanying drawings.

First Embodiment

Figure 1A:
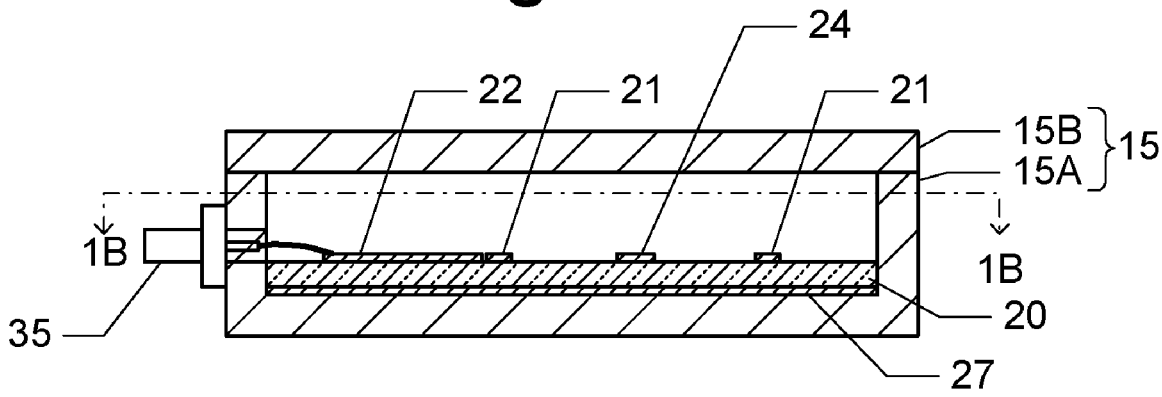
FIG. 1A is a cross sectional view of a dual mode filter according to a first embodiment.
Figure 1B:
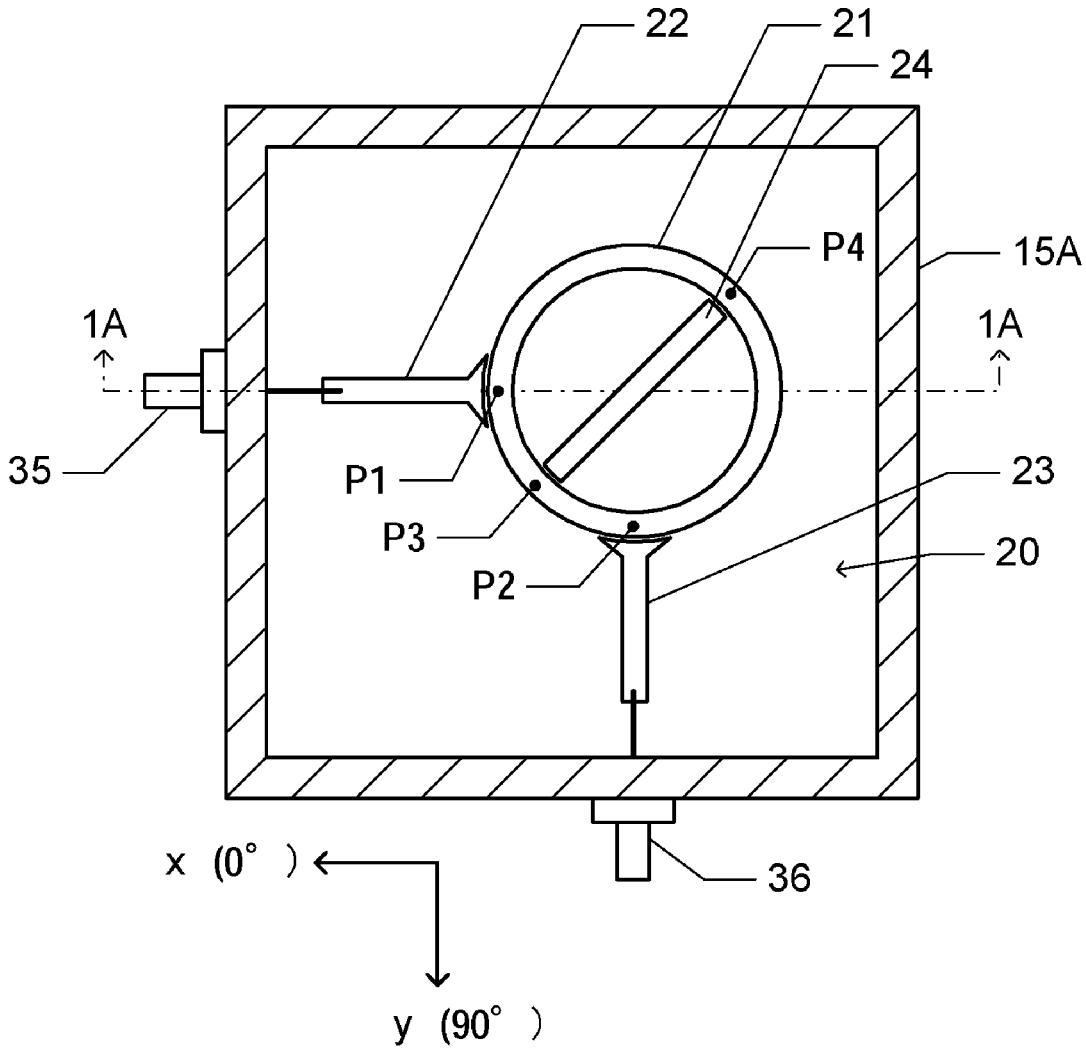
FIG. 1B is a plan cross sectional view of FIG. 1A.

FIG. 1A is a cross sectional view of a dual mode filter of the first embodiment, and FIG. 1B is a plan cross sectional view taken along one-dot chain line 1B-1B in FIG. 1A. A cross sectional view taken along one-dot chain line 1A-1A in FIG. 1B corresponds to FIG. 1A.

As illustrated in FIG. 1A and/or FIG. 1B, a [[A]] dielectric substrate 20 has a ring resonator 21 and the like formed on a principal surface and a ground film 27 (FIG. 1A) formed on a bottom surface. The dielectric substrate 20 is disposed on an inner bottom of a main body 15A of a package 15 (FIG. 1A). The ground film 27 is in contact with the inner bottom of the package main body 15A as illustrated in FIG. 1A.

The package main body 15A is a container having a rectangular parallelepiped shape with an upper opening which is closed with a ceiling plate 15B (FIG. 1A). The package main body 15A and ceiling plate 15B constitute the package 15 defining an inner closed space. The package 15 is made of, e.g., oxygen free copper having high thermal and electric conductivities. Instead of oxygen free copper, the package 15 may be made of pure aluminum, aluminum alloy, copper alloy or the like. Further, the package 15 may be made of NiCoFe alloy (KOVAR), 64FeNi (INVAR), FeNi42 (ALLOY 42) or the like having a thermal shrinkage factor near that of the dielectric substrate 20. The package 15 is gold plated to a thickness of about 2 μm in order to prevent electrical characteristics from being deteriorated by surface oxidation.

The dielectric substrate 20 is made of magnesium oxide (MgO) exposing the (100) crystal plane on the principal surface, and has a thickness of 0.5 mm. Dielectric material having a high dielectric constant and a low loss such as $LaAlO_3$ and sapphire may be used as the material of the dielectric substrate 20.

As illustrated in FIG. 1A and/or FIG. 1B, the ring resonator 21, an input feeder 22, an output feeder 23 and a dual mode generating line 24 are formed on the principal surface of the dielectric substrate 20. The ring resonator 21, input feeder 22, output feeder 23, dual mode generation line 24 and ground film 27 (FIG. 1A) have microstrip line structure. An xy-orthogonal coordinate system is defined on the principal surface of the dielectric substrate 20, an azimuth angle of the positive direction of the x-axis is defined as 0°, which is depicted as x (0°) in FIG. 1B, FIG. 2, FIG. 7A and FIG. 11A, and an azimuth angle of the positive direction of the y-axis is defined as 90°, which is depicted as y (90°) in FIG. 1B, FIG. 2, FIG. 7A and FIG. 11A.

The ring resonator 21 is constituted of a circular transmission line. When a bandpass filter of a 5 GHz band is to be manufactured on the dielectric substrate 20, a width of the transmission line constituting the ring resonator 21 is set to 0.5 mm, and a radius (center radius) of a circle drawn by a center line of the transmission line is set to 3.65 mm.

The input feeder 22 is disposed along a virtual straight line extending from the center of the ring resonator 21 in the direction of the azimuth angle of 0°, and disposed outside the ring resonator 21. The input feeder 22 and ring resonator 21 are electromagnetically coupled with each other at a point (first coupling point) P1 on the ring resonator 21 at the azimuth angle of 0°. The output feeder 23 is disposed along a virtual straight line extending from the center of the ring resonator 21 in the direction of the azimuth angle of 90°, and disposed outside the ring resonator 21. The output feeder 23 and ring resonator 21 are electromagnetically coupled with each other at a point (second coupling point) P2 on the ring resonator 21 at the azimuth angle of 90°. Namely a transmission line length from the first coupling point P1 to second coupling point P2 is substantially quarter of the line length of the ring resonator 21. Each of the input feeder 22 and output feeder 23 has a line width of 0.5 mm, and is broadened at an end portion on the ring resonator side.

The dual mode generating line 24 is disposed in an inner area of the ring resonator 21. Both ends of the dual mode generating line 24 are electromagnetically coupled with the ring resonator 21 at a third coupling point P3 and at a fourth coupling point P4 on the ring resonator 21, respectively. The third coupling point P3 positions at a cross point between the ring resonator 21 and a virtual straight line extending from the center of the ring resonator 21 in the direction of an azimuth angle of 45°. The fourth coupling point P4 positions at a cross point between the ring resonator 21 and a virtual straight line extending from the center of the ring resonator 21 in the direction of an azimuth angle of 235°. In this specification, a position of an arbitrary point on the ring resonator 21 is represented by an azimuth angle of a direction from the center of the ring resonator 21 toward that point.

The third coupling point P3 positions at a middle point of a shorter one of two transmission lines having as both ends the first and second coupling points P1 and P2, and the fourth coupling point P4 positions at a middle point of the longer one. Namely, a transmission line length from the third coupling point P3 to fourth coupling point P4 is substantially half of the transmission line length of the ring resonator 21.

The dual mode generating line 24 is a straightforward transmission line, and its line width is, for example, within a range of 0.5 mm to 1.2 mm. A gap between each of ends of the dual mode generating line 24 and the ring resonator 21 is, for example, within a range of 75 μm to 125 μm. The border of each of both ends of the dual mode generating line 24 has an arc shape in conformity with the inner circumference of the ring resonator 21. Like the input feeder 22, each end portion of the dual mode generating line 24 may be broadened.

There is a following relation between a wavelength λr of a high frequency signal resonating in the ring resonator 21 and a center radius r of the ring resonator 21:

$$2\pi r = n \times \lambda r \text{ (} n \text{ is a natural number)} \quad (1)$$

The wavelength λr at n=1 is called a "fundamental resonance wavelength" and a frequency of a high frequency signal having the fundamental resonance wavelength is called a "fundamental resonance frequency". When a center radius r is 3.65 mm, the fundamental resonance wavelength is 22.9 mm. An actual resonance wavelength is calculated from an effective dielectric constant of the microstrip line and a resonance frequency that is measured electrically.

The ring resonator 21, input feeder 22, output feeder 23, dual mode generating line 24 and ground film 27 are made of $YBa_2Cu_3O_{7-x}$ (hereinafter described as YBCO), and have a thickness within a range of 100 nm to 500 nm. Instead of YBCO, other superconductive oxide material presenting a superconductive state at a temperature of liquid nitrogen may be used. Superconductive oxide materials include R—Ba—Cu—O based (R is Nb, Ym, Sm, or Ho) material, Bi—Sr—Ca—Cu—O based material, Pb—Bi—Sr—Ca—Cu—O based material, $CuBa_pCa_qCu_rO_x$ based material ($1.5<p<2.5$, $2.5<q<3.5$, $3.5<r<4.5$) and the like.

A YBCO film can be formed, for example, by pulsed laser deposition. Each YBCO pattern on the principal surface of the dielectric substrate 20 can be formed by usual photolithography and wet etching techniques. An electrode having a laminated structure including a Cr film, a Pd film and an Au film can be formed by vapor deposition and lift-off method.

An electrode including a Cr film, a Pd film and an Au film in the recited order is formed on the surface near an end portion far from the ring resonator 21 of each of the input feeder 22 and output feeder 23.

As illustrated in FIG. 1A and/or FIG. 1B, a coaxial input connector 35 and a coaxial output connector 36 are mounted on the side wall of the package main body 15A. A center conductor of the input connector 35 is connected to the electrode at the end portion of the input feeder 22 by an Au wire having a diameter of 25 μm, and a center conductor of the output connector 36 is connected to the electrode at the end portion of the output feeder 23 by an Au wire having a diameter of 25 μm. Instead of the Au wire, an Au ribbon or an Al wire may be used.

Figure 2:
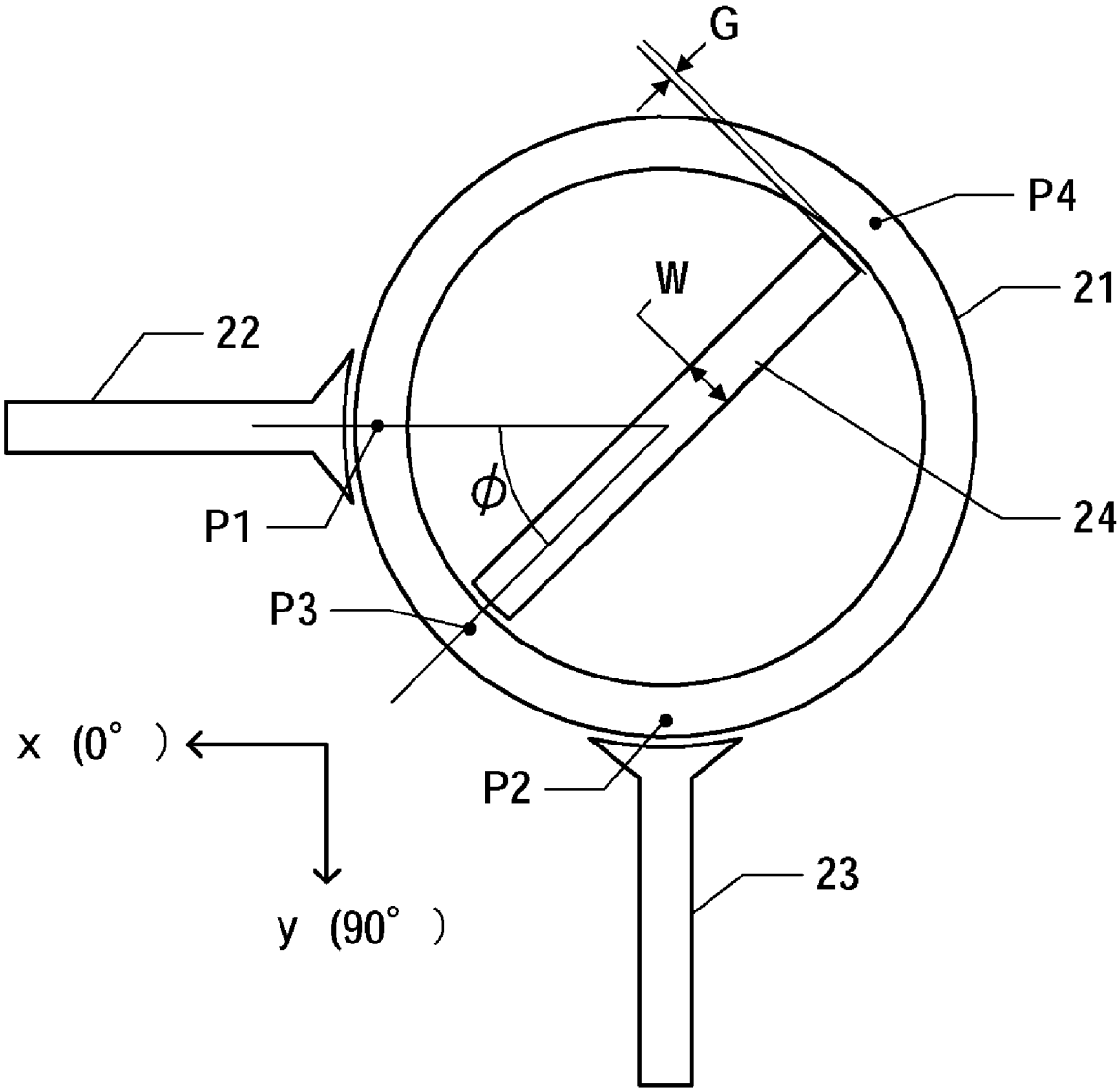
FIG. 2 is a plan view of a main portion of the dual mode filter of the first embodiment.

FIG. 2 is a plan view illustrating the ring resonator 21, input feeder 22, output feeder 23 and dual mode generating line 24. The first coupling point P1 and the second coupling point P2 are the same as those in FIG. 1B. The third coupling point P3 is arranged at a position corresponding to the azimuth angle ϕ of 45°. A line width of the dual mode generating line 24 is represented by W, and a gap between the end of the dual mode generating line 24 and the ring resonator 21 is represented by G.

Figure 3A:
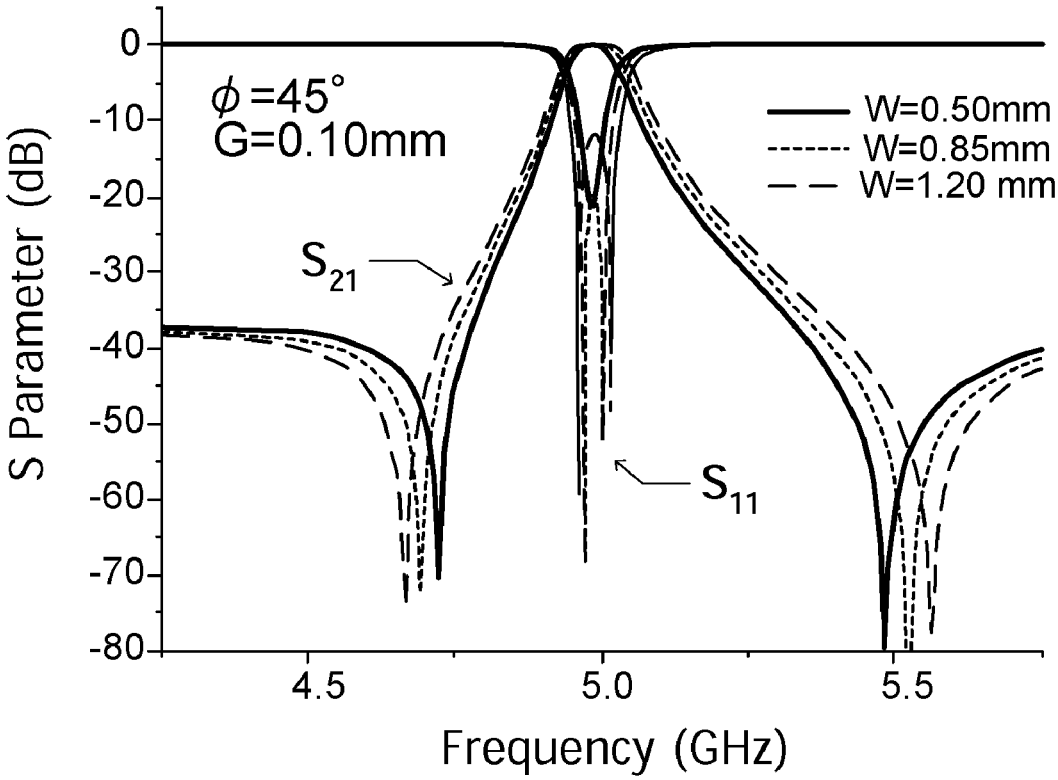
FIG. 3A is a graph illustrating the filter characteristics of the dual mode filter of the first embodiment.

FIG. 3A indicates simulation results of the filter characteristics of filters which have the dual mode generating line 24 (FIG. 2) having line widths W of 0.50 mm, 0.85 mm, and 1.20 mm, respectively. The abscissa represents a frequency in the unit of "GHz", and the ordinate represents a magnitude of an S parameter in the unit of "dB". A gap G is set to 0.10 mm and the azimuth angle is ϕ=45°. Elements $S_{11}$ and $S_{21}$ of S parameter are depicted in FIG. 3A.

It can be understood from the simulation results that dual mode resonance occurs. An attenuation pole appears on both sides of the passband.

Figure 3B:
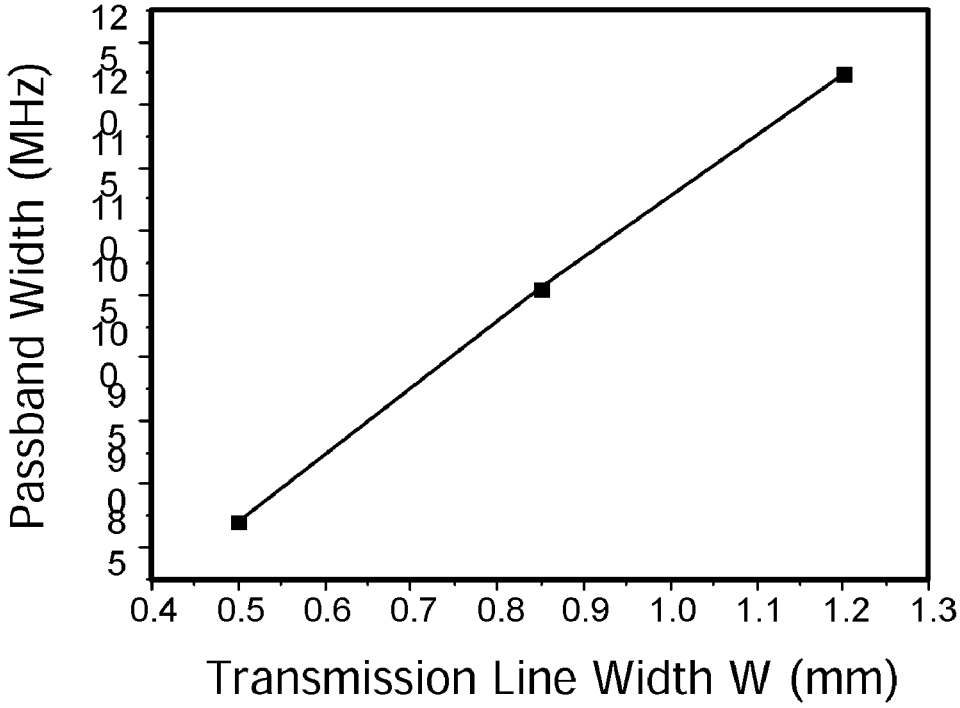
FIG. 3B is a graph illustrating the relation between a transmission line width and a passband width of a dual mode generating line.

FIG. 3B illustrates a relation between a passband width calculated from the simulation results illustrated in FIG. 3A and a transmission line width W. The abscissa represents a transmission line width W in the unit of "mm", and the ordinate represents a passband width in the unit of "MHz". It can be understood that as the line width of the dual mode generating line 24 is thicker, the passband width becomes broad.

Figure 4A:
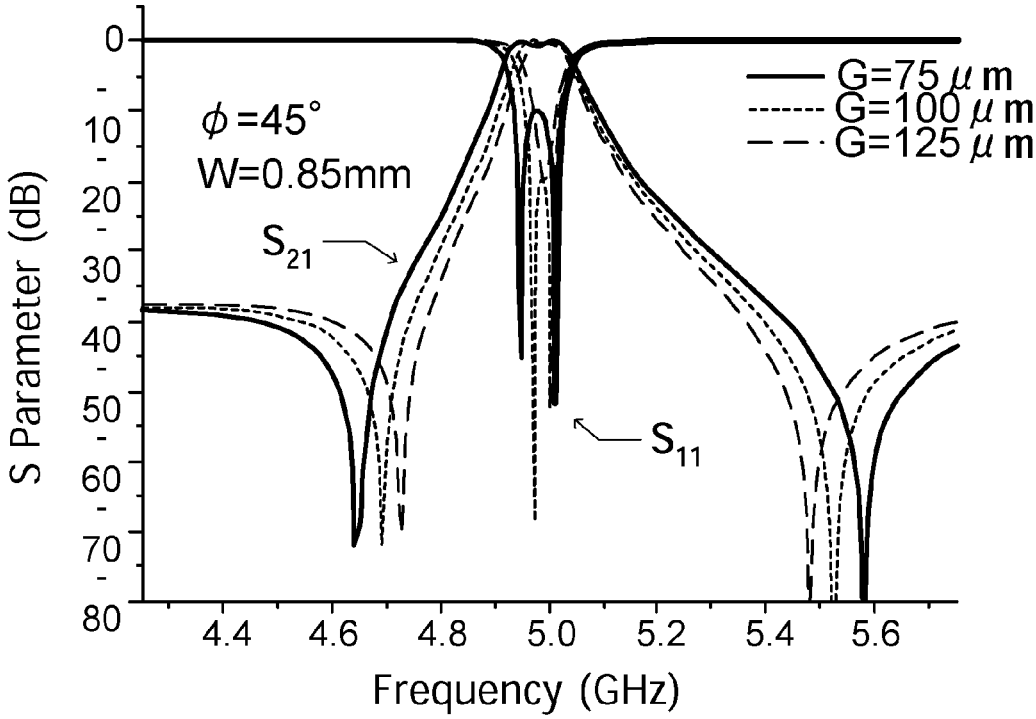
FIG. 4A is a graph illustrating the filter characteristics of the dual mode filter of the first embodiment.

FIG. 4A indicates simulation results of the filter characteristics of filters whose gaps G are 75 μm, 100 μm, and 125 μm, respectively. The abscissa represents a frequency in the unit of "GHz", and the ordinate represents a magnitude of an S parameter in the unit of "dB". A transmission line width W is set to 0.85 mm and the azimuth angle is ϕ=45°. Elements $S_{11}$ and $S_{21}$ of S parameter are depicted in FIG. 4A.

Figure 4B:
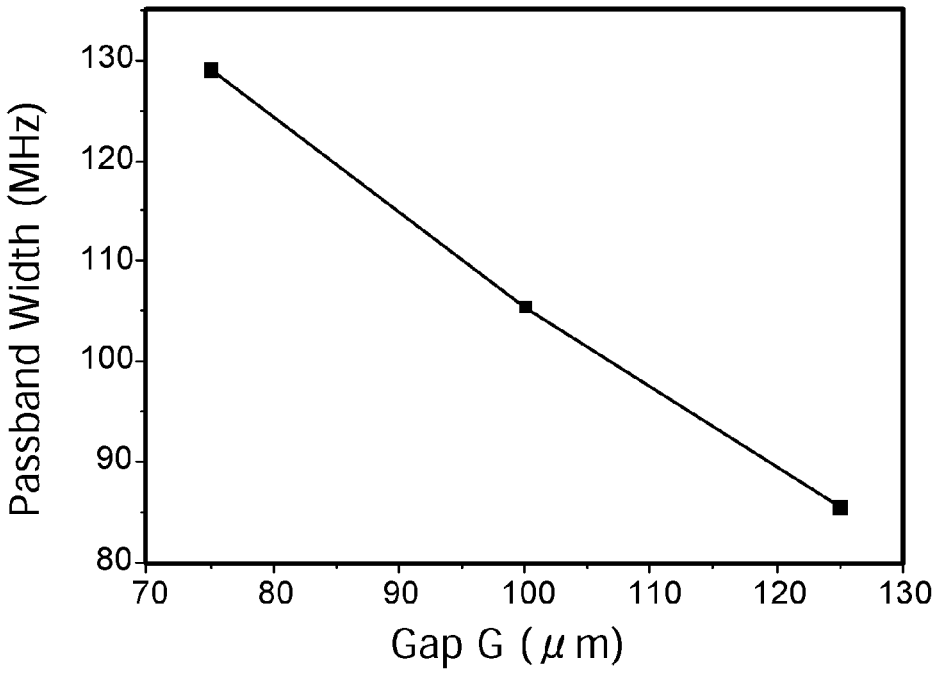
FIG. 4B is a graph illustrating the relation between a passband width and a gap between the end of the dual mode generating line and the ring resonator.

FIG. 4B illustrates a relation between a passband width calculated from the simulation results illustrated in FIG. 4A and a gap G. The abscissa represents a gap G in the unit of "μm", and the ordinate represents a passband width in the unit of "MHz". It can be understood that as the gap is narrower, i.e., as a coupling capacitance between the dual mode degenerating line 24 and ring resonator 21 is larger, the passband width becomes broad.

As understood from the simulation results indicated in FIGS. 3A, 3B, 4A and 4B, the passband width can be controlled by changing at least one of the line width W of the dual mode generating line 24 and the gap G between the end of the dual mode generating line 24 and the ring resonator 21.

A planar shape constituted of the ring generator 21 and the dual mode generating line 24 of the dual mode filter of the first embodiment is line symmetry with respect to a first straight line passing through the third coupling point P3 and fourth coupling point P4 as illustrated in FIG. 2. This planar shape is also line symmetry with respect to a second straight line crossing the first line at a right angle and passing the center of the ring resonator 21.

In the first embodiment, the third coupling point P3 is positioned at the middle point of the transmission line including the first coupling point P1 and second coupling point P2 as the both ends. Next, the filter characteristics were simulated for the case in which the third coupling point P3 is slightly deviated from the middle point.

Figure 5:
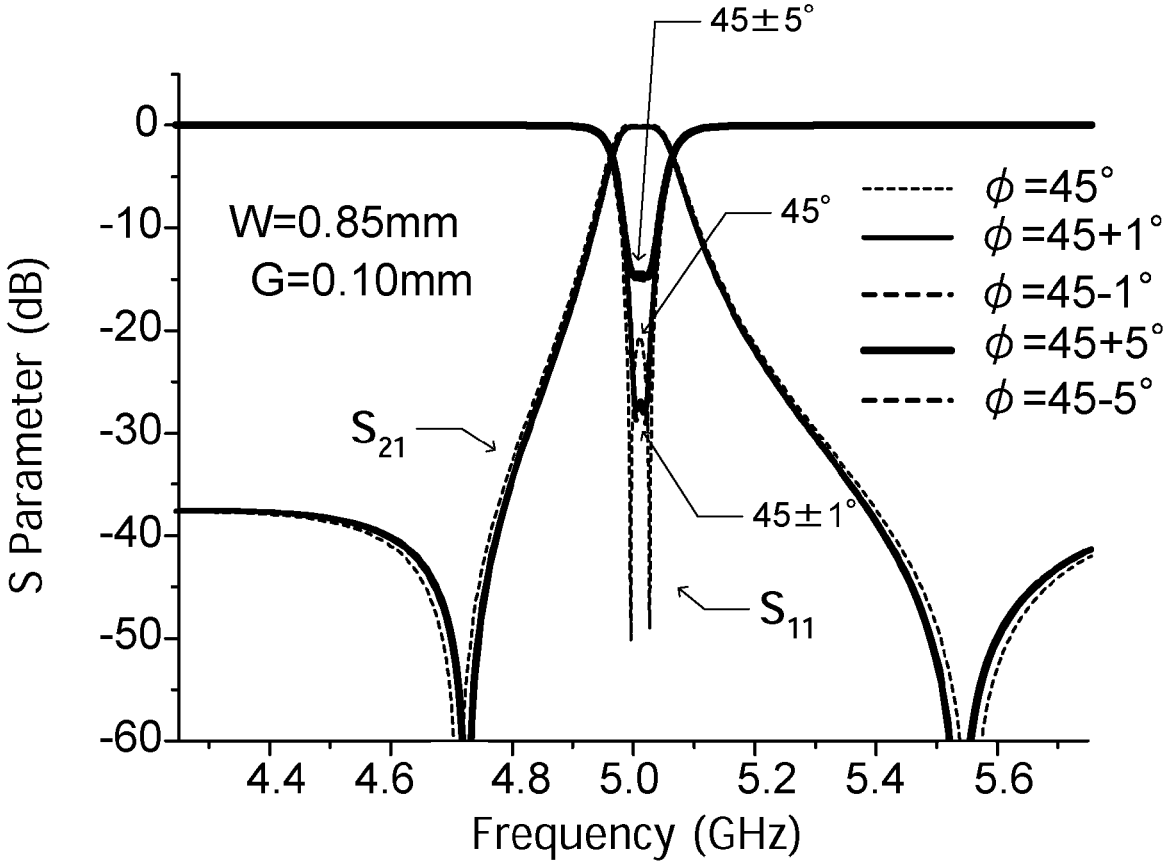
FIG. 5 is a graph illustrating the filter characteristics of the dual mode filter of the first embodiment.

FIG. 5 indicates the simulation results. The abscissa represents a frequency in the unit of "GHz", and the ordinate represents a magnitude of an S parameter in the unit of "dB". Elements $S_{11}$ and $S_{21}$ of S parameter are depicted in FIG. 5. Transmission and reflection characteristics of filters were calculated, in which azimuth angles ϕ indicating the position of the third coupling point P3 are 45°, 45°±1°, and 45°±5°, respectively. The line width W is set to 0.85 mm, and the gap G is set to 0.10 mm. When the azimuth angle ϕ deviates by 1° from 45°, $S_{11}$ is smaller. This is because passband width becomes narrower.

When the azimuth angle ϕ indicating the position of the third coupling point P3 deviates by ±5° from 45°, the passband width is narrower but $S_{11}$ is larger compared to those when the azimuth angle ϕ is 45°. Namely, the reflection characteristics are degraded. When deviation of the azimuth angle ϕ from 45° is more than 5°, the reflection characteristics are degraded further. If a deviation of the azimuth angle ϕ from 45° is equal to or smaller than 5°, a practically usable high frequency filter can be obtained.

A deviation of the azimuth angle ϕ of 5° corresponds to about 1.4% of the transmission line length of the ring resonator 21. It is therefore preferable that a transmission line length from the middle point of the shorter transmission line having as both ends the first coupling point P1 and second coupling point P2 to the third coupling point P3 is set to be equal to or shorter than 1.4% of the transmission line length of the ring resonator 21.

In the above-described first embodiment, although superconductive oxide material is used as the material of the ring resonator 21, input feeder 22, output feeder 23, dual mode generating line 24 and ground film 27, normal conductive material such as copper (Cu) may also be used.

Figure 6:
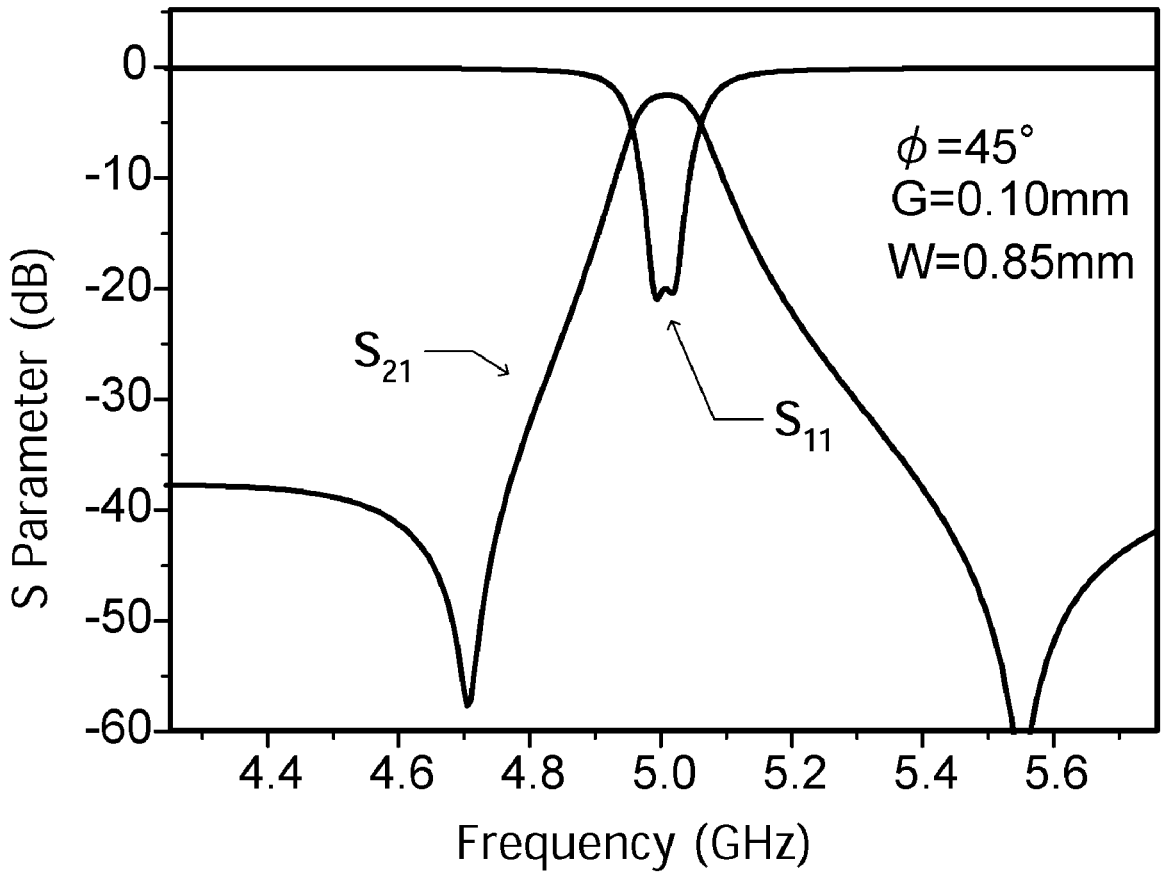
FIG. 6 is a graph illustrating the filter characteristics when copper is used as the transmission line of the dual mode filter of the first embodiment.

FIG. 6 indicates simulation results of the filter characteristics when copper is used instead of superconductive oxide material. The abscissa represents a frequency in the unit of "GHz", and the ordinate represents a magnitude of an S parameter in the unit of "dB". An azimuth angle ϕ representative of the position of the third coupling point P3 was set to 45°, a line width W of the dual mode generating line 24 was set to 0.85 mm, and a gap G was set to 0.10 mm. Elements $S_{11}$ and $S_{21}$ of S parameter are depicted in FIG. 6. Because of a loss caused by electrical resistance, the transmission and reflection characteristics are worse than using superconductive material. However, practically usable filter characteristics can be obtained.

Second Embodiment

Next, a dual mode filter of the second embodiment will be described with reference to FIGS. 7A and 7B.

Figure 7A:
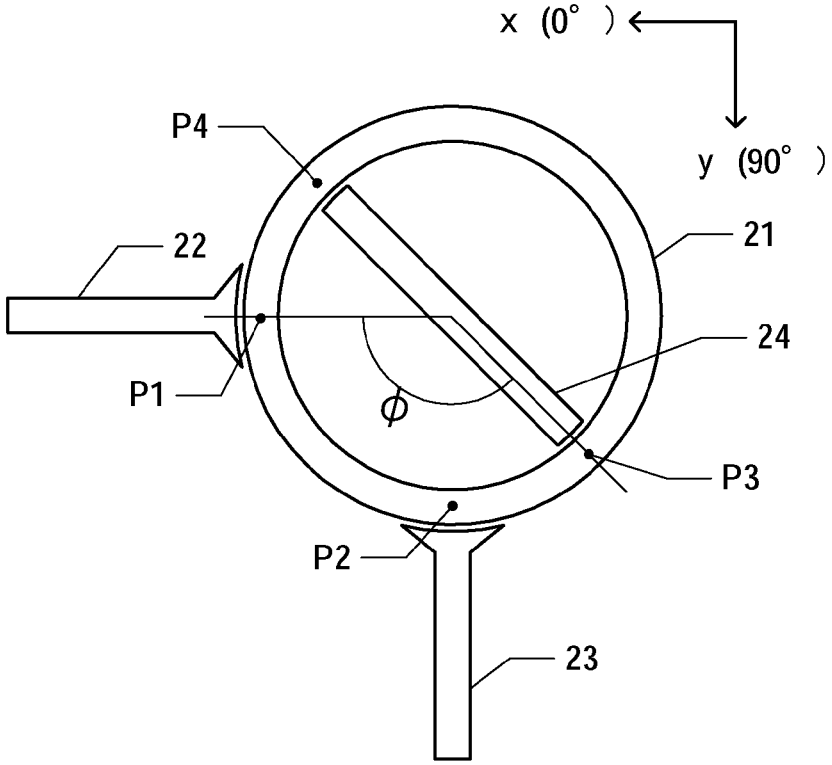
FIG. 7A is a plan view illustrating a main portion of a dual mode filter according to a second embodiment.

FIG. 7A is a plan view illustrating a main portion of a dual mode filter according to the second embodiment. The dual mode filter of the second embodiment includes a ring generator 21, an input feeder 22, an output feeder 23 and a dual mode generating line 24. In the first embodiment, the azimuth angle $\phi$ representative of the position of the third coupling point P3 is 45°, whereas in the second embodiment, the azimuth angle $\phi$ is 135°. The azimuth angle representative of the fourth coupling point P4 is 315°. Other structures are the same as those of the dual mode filter of the first embodiment.

In the second embodiment, a transmission line length from the middle point of a shorter transmission line having as both ends the first coupling point P1 and second coupling point P2 to the third coupling point P3 is substantially quarter of the transmission line length of the ring resonator 21.

Figure 7B:
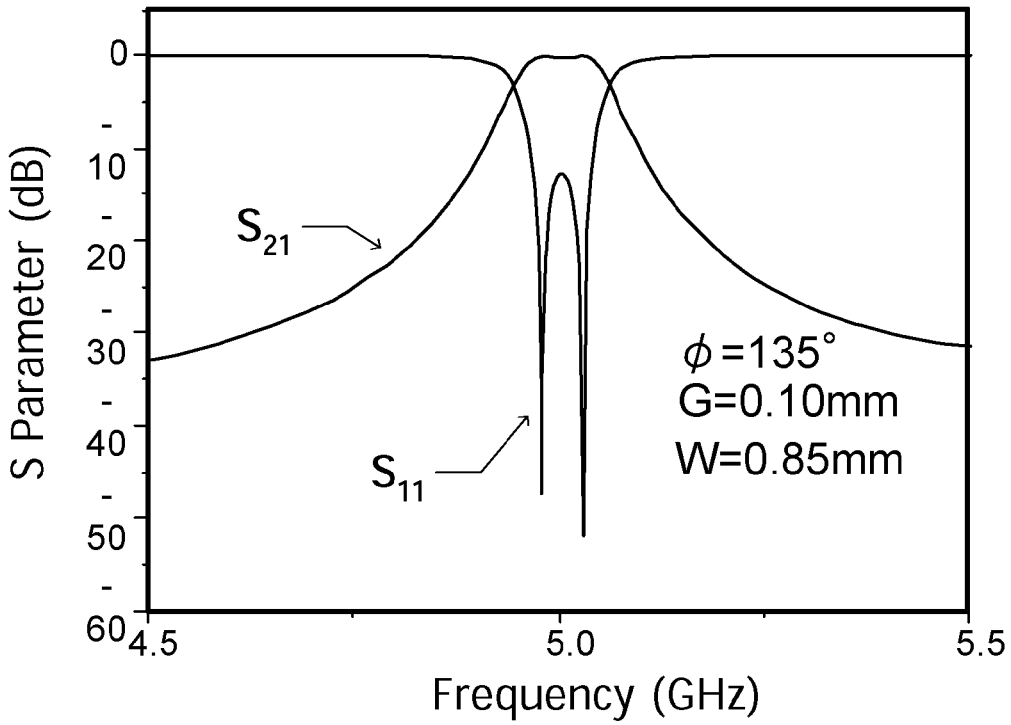
FIG. 7B is a graph illustrating the filter characteristics of the dual mode filter of the second embodiment.

FIG. 7B indicates simulation results of the filter characteristics of the dual mode filter of the second embodiment. The abscissa represents a frequency in the unit of "GHz", and the ordinate represents a magnitude of an S Parameter in the unit of "dB". A line width W of the dual mode generating line 24 was set to 0.85 mm, and a gap G was set to 0.10 mm. Elements $S_{11}$ and $S_{21}$ of S parameter are depicted in FIG. 7B. Also in the second embodiment, it can be seen that dual mode resonance occurs. However, an attenuation pole does not appear on both sides of a passband, as different from the first embodiment.

In the above-described second embodiment, as illustrated in FIG. 7A, the third coupling point P3 is arranged in such a manner that a transmission line length from the middle point of the shorter transmission line having as both ends the first coupling point P1 and second coupling point P2 to the third coupling point P3 is substantially quarter of the transmission line length of the ring resonator 21. This position of the third coupling point P3 is an ideal position. As in the case of the first embodiment, the third coupling point P3 may be deviated from the ideal position of the third coupling point P3 by a transmission line length equal to or shorter than 1.4% of the transmission line length of the ring resonator 21.

Third Embodiment

Figure 8:
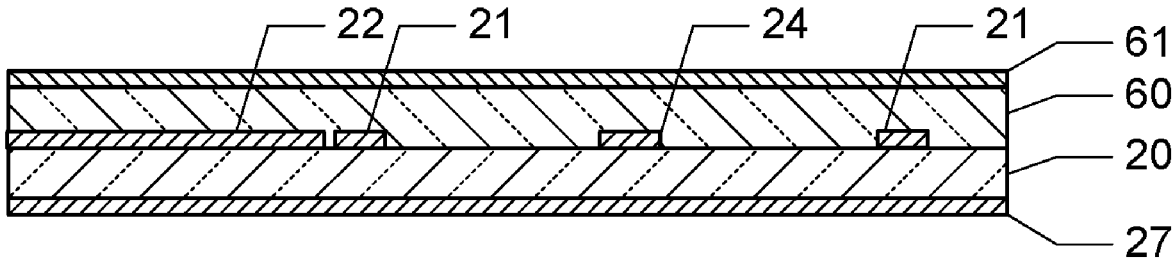
FIG. 8 is a cross sectional view of a dual mode filter according to a third embodiment.

FIG. 8 is a cross sectional view illustrating a main portion of a dual mode filter according to the third embodiment. Although the first and second embodiments adopt the microstrip line structure disposing the ground film 27 only on one side of the ring resonator 21, the input feeder 22, the dual mode generating line 24 and the like, the third embodiment adopts a strip line structure disposing the ground film on both sides of the ring resonator 21 and the like.

The structure of a dielectric substrate 20, the structures of a ring resonator 21 and the like on the principal surface of the substrate 20, and the structure of the ground film 27 on the bottom surface are the same as those of the first embodiment. A dielectric film 60 is disposed on the principal surface of the dielectric substrate 20, covering the ring resonator 21 and the like. The upper ground film 61 is disposed on the surface of the dielectric film 60.

Even with the above-described strip line structure, the same effects as those of the microstrip line structure of the first embodiment can be obtained.

Fourth Embodiment

Figure 9A:
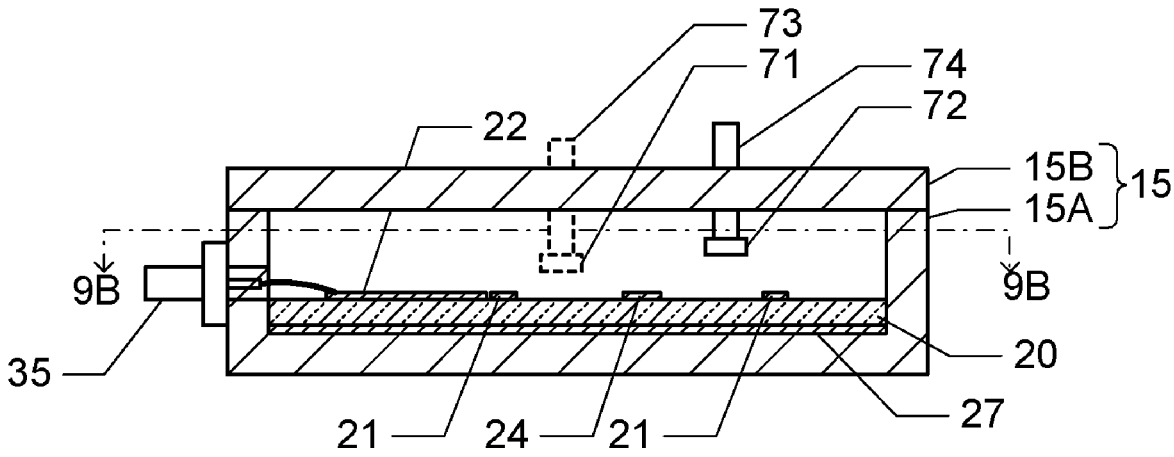
FIG. 9A is a cross sectional view of a dual mode filter according to a fourth embodiment.
Figure 9B:
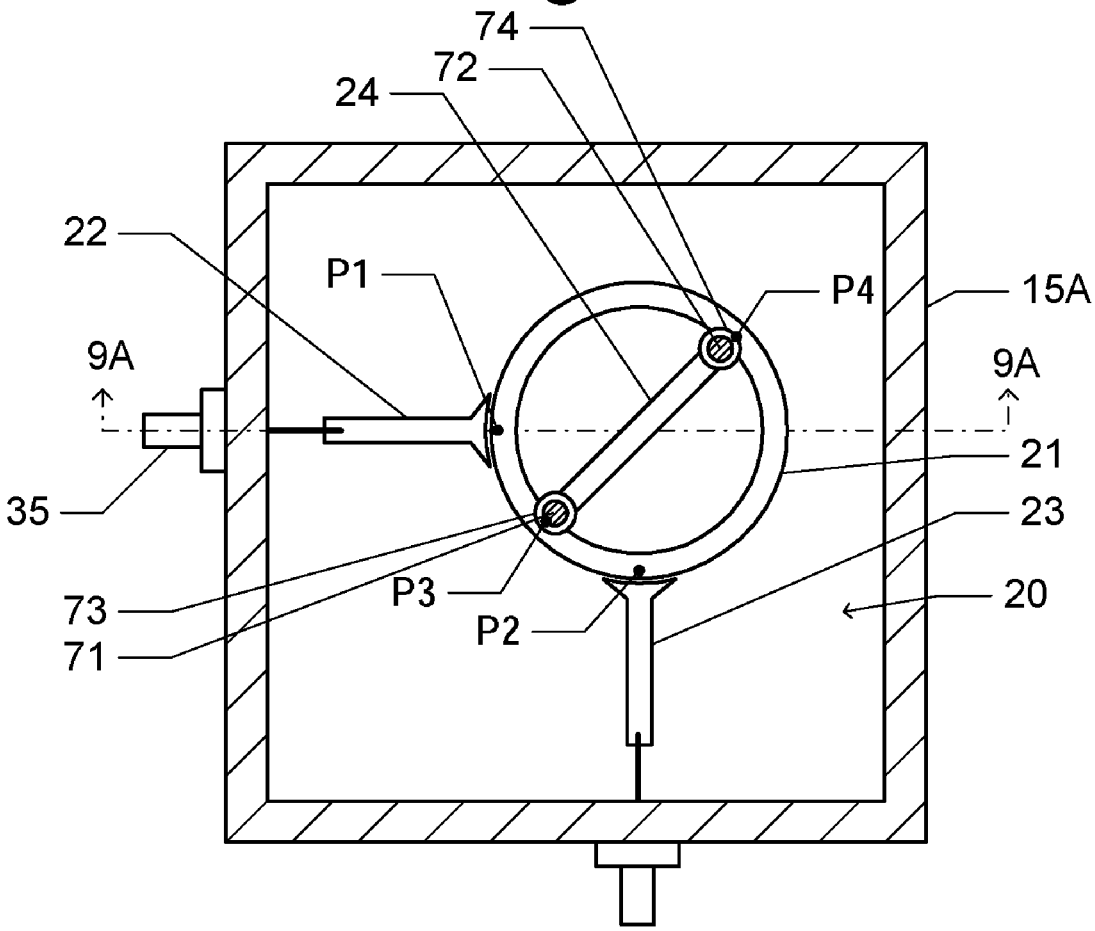
FIG. 9B is a plan cross sectional view of FIG. 9A.

FIG. 9A is a cross sectional view of a dual mode filter according to the fourth embodiment. FIG. 9B is a plan cross sectional view taken along one-dot chain line 9B-9B in FIG. 9A. A cross sectional view taken along one-dot chain line 9A-9A in FIG. 9B corresponds to FIG. 9A. In the following description, attention is paid to different points from the dual mode filter illustrated in FIGS. 1A and 1B, and the description of the components having the same structure is omitted. For example, the first coupling point P1 and the second coupling point P2 in FIG. 9B are the same as those in FIG. 1B. The input feeder 22, the ground film 27, the package main body 15A, the ceiling plate 15B, and the output feeder 23 in FIG. 9A and/or FIG. 9B are the same as those in FIG. 1A and FIG. 1B.

A first dielectric member 71 and a second dielectric member 72 are disposed above a dielectric substrate 20. The first dielectric member 71 is disposed in a nearby area close to the third coupling point P3, whereas the second dielectric member 72 is disposed in a nearby area close to the fourth coupling point P4. The term "nearby area" used herein is defined as an area which is under the influence of an electromagnetic field generated in a coupling portion between the ring resonator 21 and the dual mode generating line 24. MgO or the like may be used as the material of the first dielectric member 71 and second dielectric member 72.

The first dielectric member 71 is supported by a package 15 (FIG. 9A) via a first support member 73. The first support member 73 can move up and down the first dielectric member 71. Namely, a distance between the first dielectric member 71 and dielectric substrate 20 can be changed. In the state that the first dielectric member 71 is moved downmost, the first dielectric member 71 is in contact with the ring resonator 21 and dual mode generating line 24.

The first support member 73 may be a screw being screwed into a through hole formed through a ceiling plate 15B (FIG. 9A) of the package 15. As the screw is rotated, the first dielectric member 71 can be moved up and down. The first support member 73 may be a linear actuator for translating an object upon reception of an external drive signal.

As in the case of the first dielectric member 71, the second dielectric member 72 is supported by the package 15 via a second support member 74 so as to move up and down.

As the first dielectric member 71 and second dielectric member 72 are moved up and down, a coupling capacitance between the ring resonator 21 and dual mode generating line 24 changes. This change is equivalent to a change in the gap (corresponding to the gap G illustrated in FIG. 2) between each end of the dual mode generation line 24 and the ring resonator 21. A passband width of the filter can therefore be changed by moving up and down at least one of the first dielectric member 71 and second dielectric member 72.

Fifth Embodiment

Figure 10A:
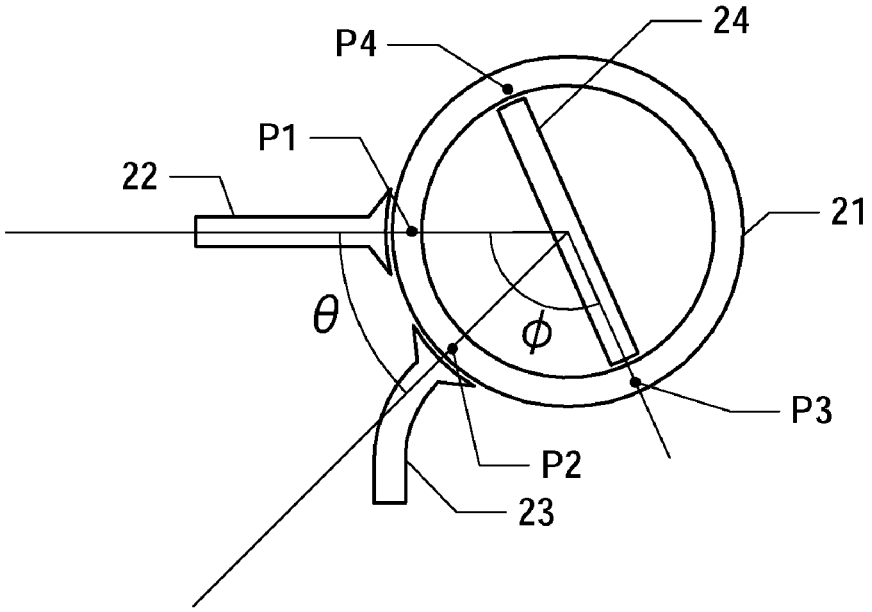
FIG. 10A is a plan view illustrating a main portion of a dual mode filter according to a fifth embodiment.

FIG. 10A is a plan view illustrating a main portion of a dual mode filter according to the fifth embodiment. In the first embodiment, the second coupling point P2, at which the output feeder 23 and ring resonator 21 are coupled with each other, is arranged at the position at the azimuth angle of 90°, whereas in the fifth embodiment, an azimuth angle $\theta$ representative of the position of a second coupling point P2 is 45°. An azimuth angle $\phi$ representative of the position of a third coupling point P3 is 112.5°, and an azimuth angle representative of the position of a fourth coupling point P4 is 292.5°. Other structures are the same as those of the dual mode filter of the first embodiment.

In the fifth embodiment, a transmission line length from the first coupling point P1 to the second coupling point P2 is substantially one-eighth (⅛) of the transmission line length of the ring resonator 21. As in the case of the second embodiment, a transmission line length from a middle point of a shorter transmission line having as both ends the first coupling point P1 and second coupling point P2 to the third coupling point P3 is substantially quarter of the transmission line length of the ring resonator 21.

Since the transmission line length from the first coupling point P1 to the second coupling point P2 is substantially ⅛ of the transmission line length of the ring resonator 21, a high frequency signal having the fundamental resonance frequency is hardly transmitted from the input feeder 22 to the output feeder 23, but a high frequency signal having frequency twice as height as the fundamental resonance frequency is transmitted to the output feeder 23.

Figure 10B:
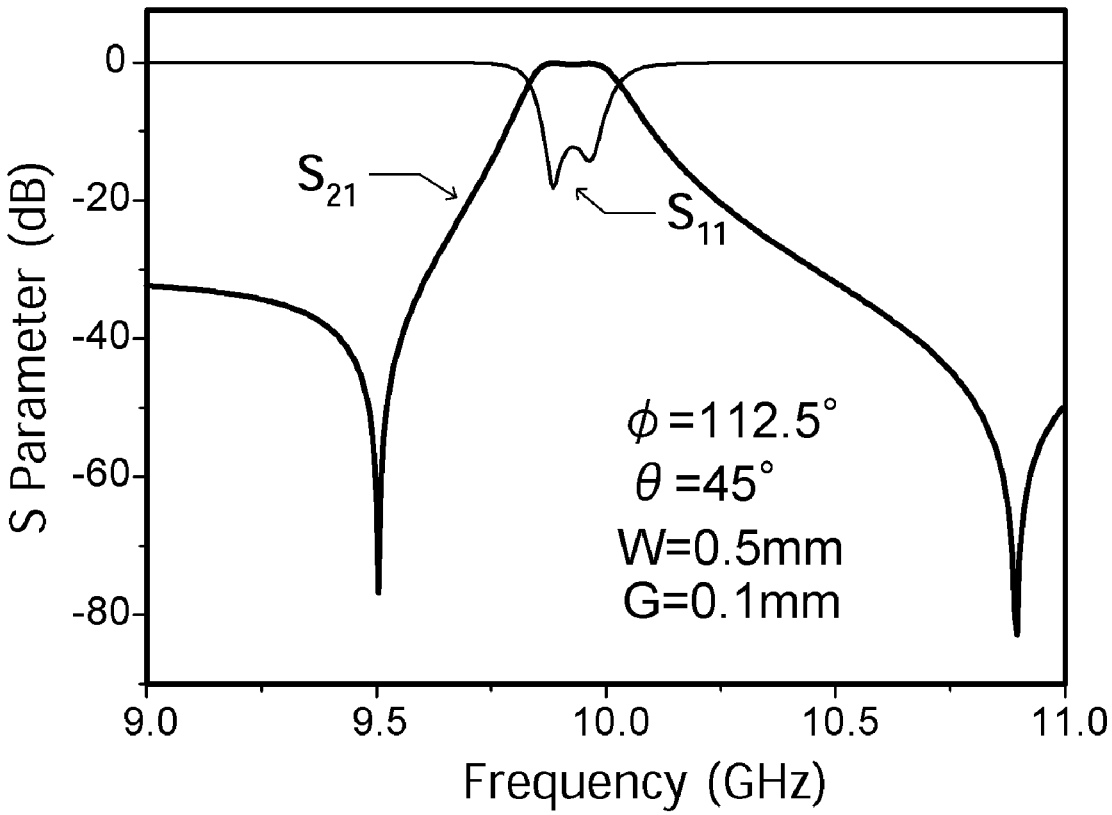
FIG. 10B is a graph illustrating the filter characteristics of the dual mode filter of the fifth embodiment.

FIG. 10B indicates the filter characteristics of the dual mode filter of the fifth embodiment. The abscissa represents a frequency in the unit of "GHz", and the ordinate represents a magnitude of an S parameter in the unit of "dB". A line width W of the dual mode generating line 24 was set to 0.5 mm, and a gap G was set to 0.1 mm. The azimuth angle ϕ and the azimuth angle θ are set to 112.5° and 45°, respectively. Elements $S_{11}$ and $S_{21}$ of S parameter are depicted in FIG. 10B. A passband of the filter of the first embodiment is close to 5 GHz, whereas a passband of the filter of the fifth embodiment is close to 10 GHz. Also in the fifth embodiment, dual mode resonance occurs, and an attenuation pole appears on both sides of the passband.

Figure 11A:
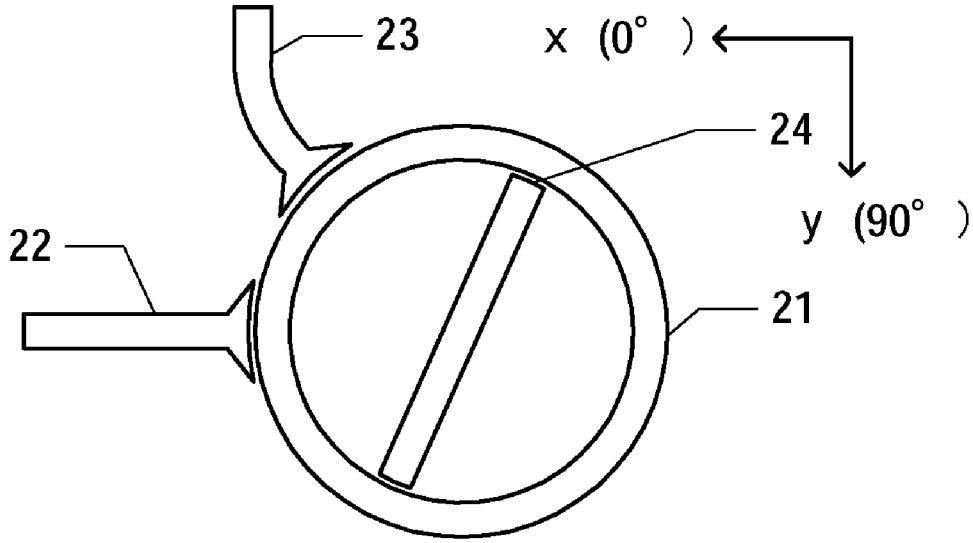
FIG. 11A is a plan view illustrating a main portion of a dual mode filter according to a modification of the fifth embodiment.

FIG. 11A is a plan view illustrating a main portion of a dual mode filter according to a modification of the fifth embodiment. Planar shape of a ring resonance 21, an input feeder 22, an output feeder 23 and a dual mode generating line 24 of the filter illustrated in FIG. 11A has a mirror image of the planar shape of the fifth embodiment illustrated in FIG. 10A.

Also with respect to the first embodiment illustrated in FIGS. 1B and 2 and the second embodiment illustrated in FIG. 7A, respectively, dual mode filters can be manufactured having planar shape in a mirror image relation to the planar shape of the ring resonator 21, input feeder 22, output feeder 23 and dual mode generating line 24.

Sixth Embodiment

Figure 11B:
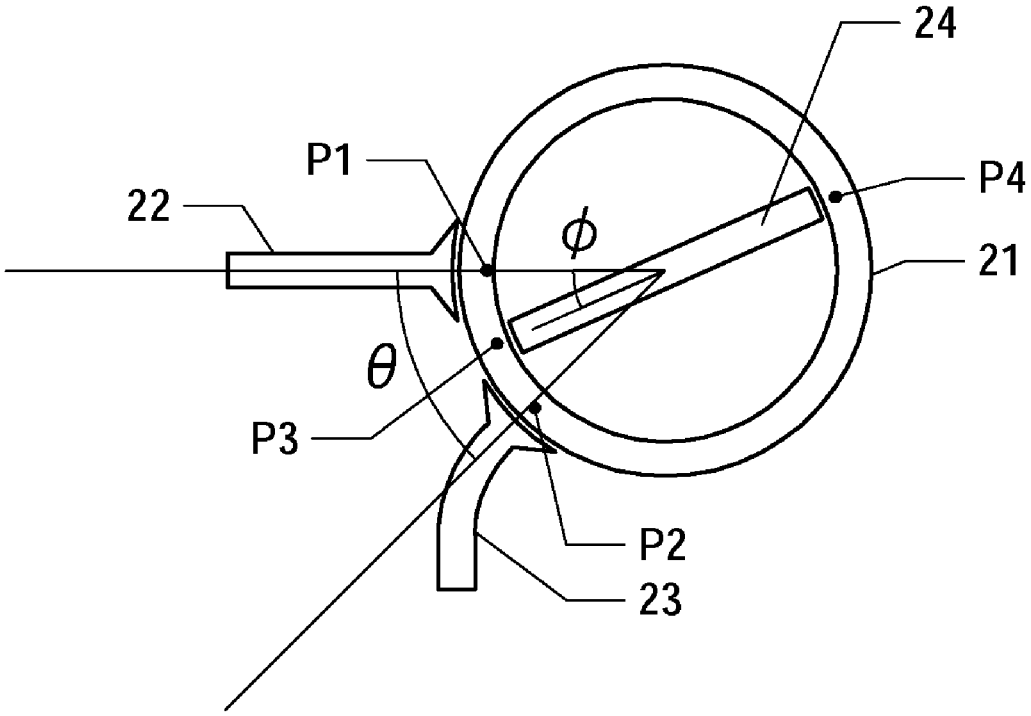
FIG. 11B is a plan view illustrating a main portion of a dual mode filter according to a sixth embodiment.

FIG. 11B is a plan view illustrating a main portion of a dual mode filter according to the sixth embodiment. The dual mode filter of the sixth embodiment includes a ring generator 21, an input feeder 22, an output feeder 23 and a dual mode generating line 24. The azimuth angle θ is the same as that in FIG. 10A. In the example illustrated in FIG. 11B, an azimuth angle ϕ representative of the position of a third coupling point P3 is 22.5°, and an azimuth angle representative of the position of a fourth coupling point P4 is 202.5°. Namely, the third coupling point P3 is arranged at the middle point of a shorter transmission line having as both ends the first coupling point P1 and second coupling point P2.

Seventh Embodiment

Figure 12A:
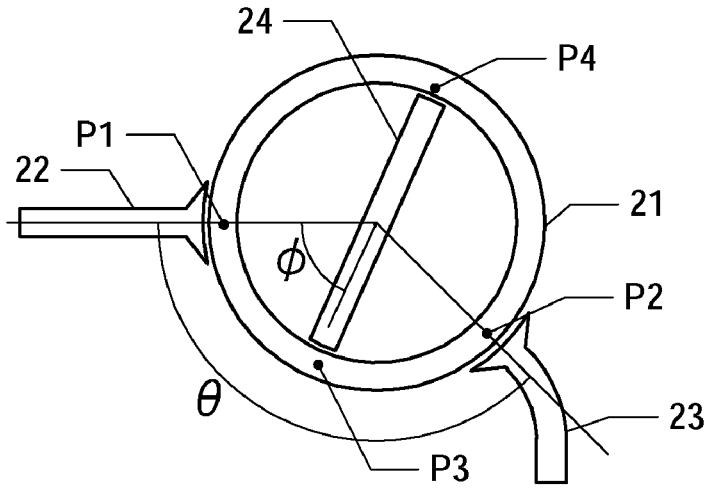
FIG. 12A is a plan view illustrating a main portion of a dual mode filter according to a seventh embodiment.

FIG. 12A is a plan view illustrating a main portion of a dual mode filter according to the seventh embodiment. The dual mode filter of the seventh embodiment includes a ring generator 21, an input feeder 22, an output feeder 23, a dual mode generating line 24, the first coupling point P1, the second coupling point P2, the third coupling point P3 and the fourth coupling point P4. In the seventh embodiment, an azimuth angle θ representative of the position of a second coupling point P2 is 135°. Namely, a transmission line length from the first coupling point P1 to the second coupling point P2 is substantially three-eighth (⅜) of the transmission line length of the ring resonator 21. An azimuth angle ϕ representative of the position of a third coupling point P3 is 67.5°. Namely, the third coupling point P3 is arranged at the middle point of the shorter transmission line having as both ends the first coupling point P1 and second coupling point P2.

Figure 12B:
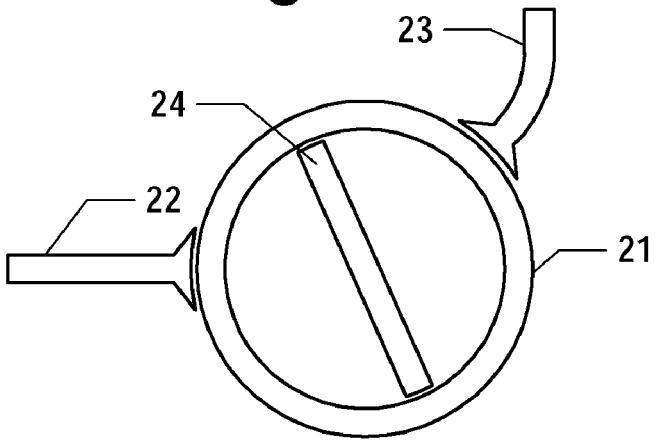
FIG. 12B illustrates a modification of the seventh embodiment.

FIG. 12B is a plan view of a filter having mirror image patterns of the dual mode filter illustrated in FIG. 12A. The dual mode filter illustrated in FIG. 12B includes a ring generator 21, an input feeder 22, an output feeder 23 and a dual mode generating line 24.

Eight Embodiment

Figure 12C:
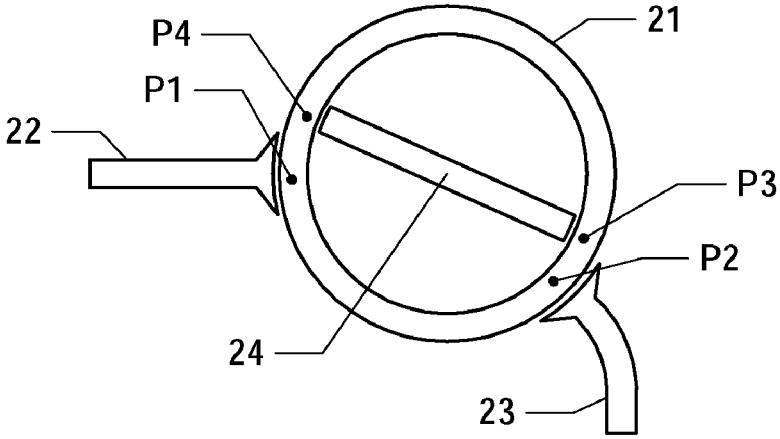
FIG. 12C is a plan view illustrating a main portion of a dual mode filter according to an eighth embodiment.

FIG. 12C is a plan view illustrating a main portion of a dual mode filter according to the eighth embodiment. The dual mode filter of the eighth embodiment includes a ring generator 21, an input feeder 22, an output feeder 23, a dual mode generating line 24, the first coupling point P1, the second coupling point P2, the third coupling point P3 and the fourth coupling point P4. In the eighth embodiment, an azimuth angle representative of the position of the second coupling point P2 is 135° which is the same as that of the embodiment illustrated in FIG. 12A. Azimuth angles representative of a third coupling point P3 and a fourth coupling point P4 are 157.5° and 337.5°, respectively. Namely, as in the case of the second embodiment illustrated in FIG. 7A, a transmission line length from the middle point of a shorter transmission line having as both ends the first coupling point P1 and second coupling point P2 to the third coupling point P3 is substantially quarter of the transmission line length of the ring resonator 21.

A dual mode filter can also be manufactured having mirror image patterns of the eighth embodiment.

The dual mode filters of the sixth to eighth embodiments operate as filters of the 10 GHz band as in the case of the fifth embodiment.

Ninth Embodiment

Figure 13:
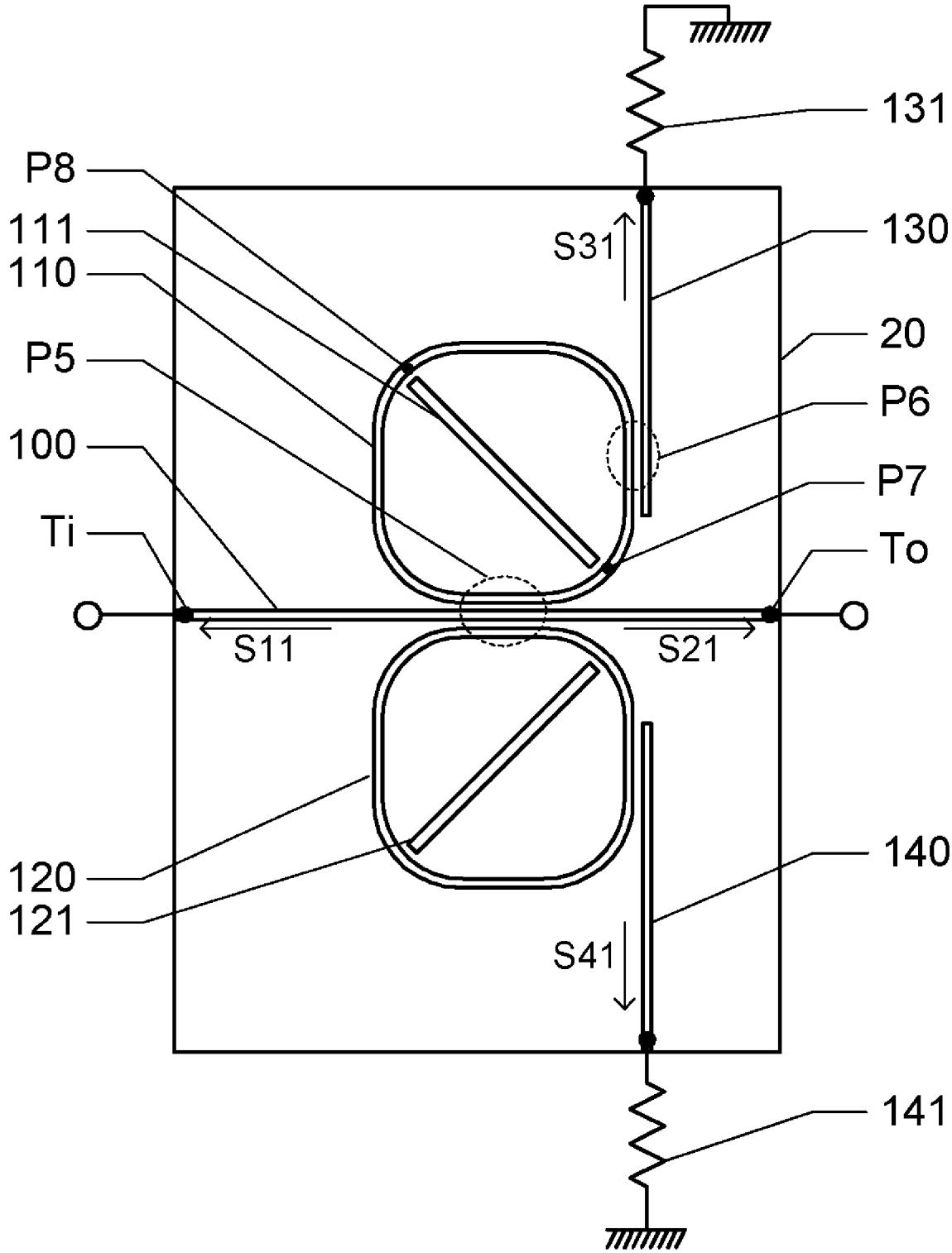
FIG. 13 is a plan view illustrating a main portion of a dual mode filter according to a ninth embodiment.

FIG. 13 illustrates conductive patterns on a dielectric substrate of a dual mode filter of the ninth embodiment. S11, S21, S31 and S41 correspond to S11, S21, S31 and S41 in FIG. 14, respectively.

A straight line main transmission line 100 is formed on a dielectric substrate 20. One end (left end in FIG. 13) of the main transmission line 100 serves as an input terminal Ti, and the other (right end in FIG. 13) serves as an output terminal To. On both sides of the main transmission line 100, a first ring resonator 110 and the second ring resonator 120 are formed, respectively. The ring resonator 21 of the first embodiment illustrated in FIG. 1B has a plan shape formed along a circumference of a circle, whereas each of the first ring resonator 110 and the second ring resonator 120 of the ninth embodiment has a plan shape formed along an outer periphery of a square with rounded corners. Namely, each of the first ring resonator 110 and the second ring resonator 120 is constituted of four straight line portions along four sides of a square, and portions along arc having a center angle of 90°, adjacent two straight line portions being connected by the arc portion.

One straight line portion of the first ring resonator 110 is disposed on a side of and in parallel to the main transmission line 100, and is electromagnetically coupled with the main transmission line 100 at a coupling position P5. Coupling between the main transmission line 100 and first ring resonator 110 is stronger compared with the case where the plan shape of the first ring resonator 110 is circular.

A first subsidiary transmission line 130 having a straight line shape is disposed along another straight line portion of the first ring resonator 110 and outside the first ring resonator 110. The first subsidiary transmission line 130 is coupled with the first ring resonator 110 at a coupling position P6. The straight line portion coupled with the first subsidiary transmission line 130 is adjacent to the straight line portion coupled with the main transmission line 100. Namely, of the first ring resonator 110, a transmission line length from the coupling position P5 coupled with the main transmission line 100 to the coupling position P6 coupled with the first subsidiary transmission line is substantially quarter of the transmission line length of the first ring resonator 110. An extension direction of the first subsidiary transmission line 130 is substantially perpendicular to an extension direction of the main transmission line 100. Therefore, the first subsidiary transmission line 130 is not directly coupled with the main transmission line 100.

A first dual mode generating line 111 is formed in an inner area of the first ring resonator 110. The first dual mode generating line 111 is electromagnetically coupled with the first ring resonator 110 at its both ends. A line length from a position P7 coupled with one end to a position P8 coupled with the other end is substantially half of the transmission line length of the first ring resonator 110, as in the case of the first embodiment.

In the example illustrated in FIG. 13, one end of the first dual mode generating line 111 is coupled with the first ring resonator 110 at a middle point P7 of the arc portion coupling the straight line portion coupled with the main transmission line 100 to the straight line portion coupled with the first subsidiary transmission line 130. The other end is coupled with the first ring resonator 110 at a middle point P8 of the diagonally positioned arc portion. Namely, both ends of the first dual mode generating line 111 are coupled with the first ring resonator 110 at the middle points P7 and P8 of two transmission lines from the coupling position P5 coupled with the main transmission line 100 to the coupling position P6 coupled with the first subsidiary transmission line 130.

The second ring resonator 120, a second dual mode generating line 121, and a second subsidiary transmission line 140 have the line-symmetric shape of the first ring resonator 110, first dual mode generating line 111 and first subsidiary transmission line 130, with respect to the main transmission line 100.

These transmission lines are made of, e.g., a YBCO film having a thickness of 500 nm. A line width of each of the main transmission line 100, first and second subsidiary transmission lines 130 and 140, and first and second ring resonators 110 and 120 is 0.5 mm. A line width of each of the first and second dual mode generating lines 111 and 121 is 0.85 mm. A transmission line length of each of the first and second ring resonators 110 and 120 is the same as that of a circular ring resonator having a center radius of 3.65 mm. A gap between the straight line portion of the ring resonator and the transmission line coupled therewith is 100 μm.

This dielectric substrate 20 is accommodated in a package similar to the package 15 of the first embodiment illustrated in FIG. 1B. The input terminal Ti, output terminal To, and output terminal of the first subsidiary transmission line 130 and output terminal of the second subsidiary transmission line 140 are led to the outside of the package via connectors mounted on the package.

The output terminal of the first subsidiary transmission line 130 is grounded via a first terminating resistor 131 disposed outside the package. An impedance of the first terminating resistor 131 is matched with a characteristic impedance of the first subsidiary transmission line 130. The output terminal of the second subsidiary transmission line 140 is grounded via a second terminating resistor 141 in the same manner.

Of a high frequency signal input from the input terminal Ti, frequency components resonating with the first and second ring resonators 110 and 120 propagate to the first and second subsidiary transmission lines 130 and 140 via the first and second ring resonators 110 and 120, respectively. Powers of the high frequency signals propagated to the first and second subsidiary transmission lines 130 and 140 are consumed at the terminating resistors 131 and 141.

Of a high frequency signal input from the input terminal Ti, frequency components not resonating with the first and second ring resonators 110 and 120 propagate directly through the main transmission line 100, and reach the output terminal To.

Figure 14:
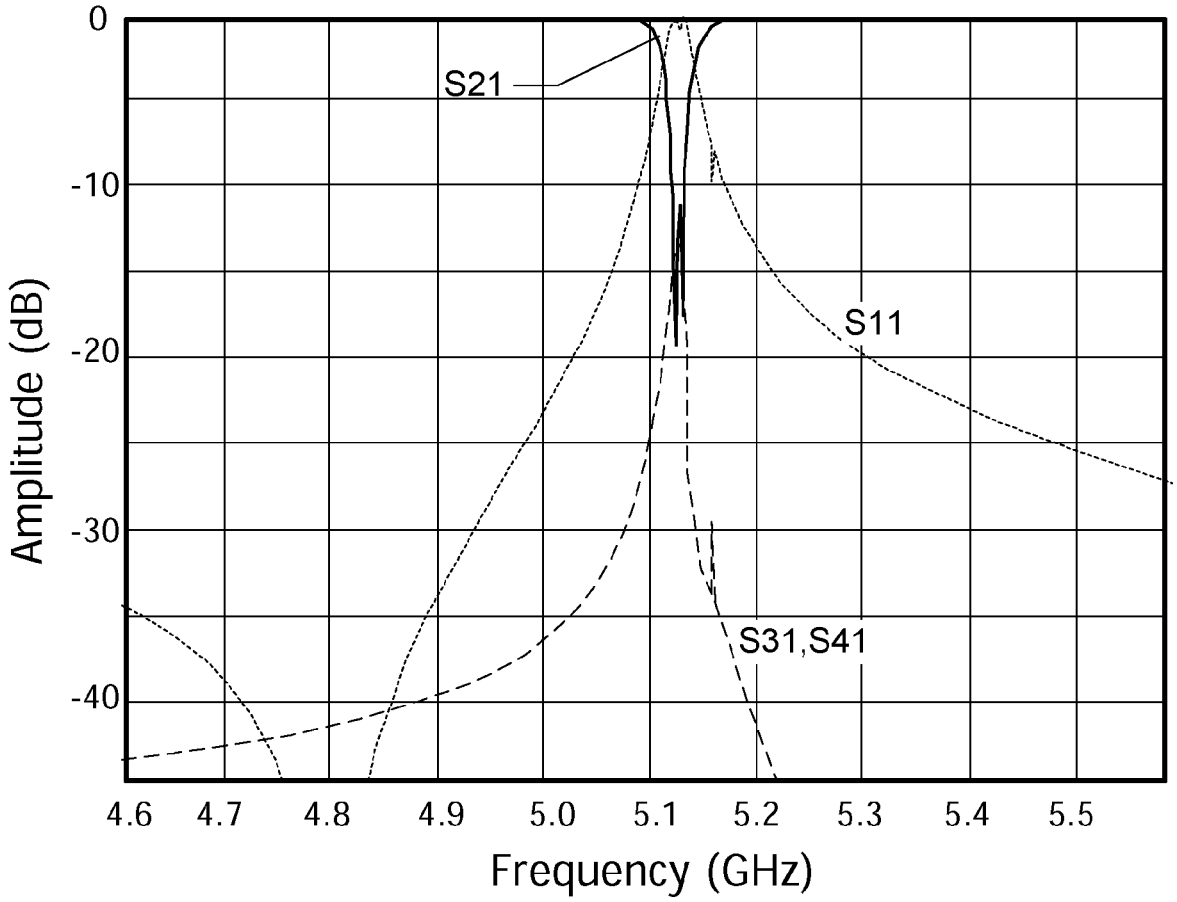
FIG. 14 is a graph illustrating the filter characteristics of the dual mode filter of the ninth embodiment.

FIG. 14 indicates simulation results of spectra of amplitudes of signals propagating through respective transmission lines. The abscissa represents a frequency in the unit of "GHz", and the ordinate represents an Amplitude in the unit of "dB". A solid line S21 drawn in FIG. 14 indicates an amplitude of a signal output to the output terminal To (FIG. 13), a dotted line S11 indicates an amplitude of a reflected wave returning to the input terminal Ti (FIG. 13), and broken lines S31 and S41 indicate amplitudes of signals output to the output terminals of the first and second subsidiary transmission lines 130 and 140 (FIG. 13). A resonance frequency of each of the first and second ring resonators 110 and 120 is about 5.13 GHz.

It can be understood that a signal appears at the output terminals of the first and second subsidiary transmission lines 130 and 140, and a signal output to the output terminal To is attenuated, in a frequency range near the resonance frequency.

Generally, when a high frequency signal to be transmitted is power-amplified at a radio transmission station, unnecessary frequency components are generated by amplitude strain or the like. These unnecessary frequency components can be removed by propagating the unnecessary frequency components to the first and second subsidiary transmission lines 130 and 140 of the dual mode filter of the ninth embodiment. Since a power of the unnecessary frequency components is sufficiently smaller than a signal power, a power of frequency components flowing in the first and second ring resonators 110 and 120 is sufficiently smaller than the signal power. A resonator having low-power resistance can therefore be used as the first and second ring resonators 110 and 120.

Tenth Embodiment

Figure 15:
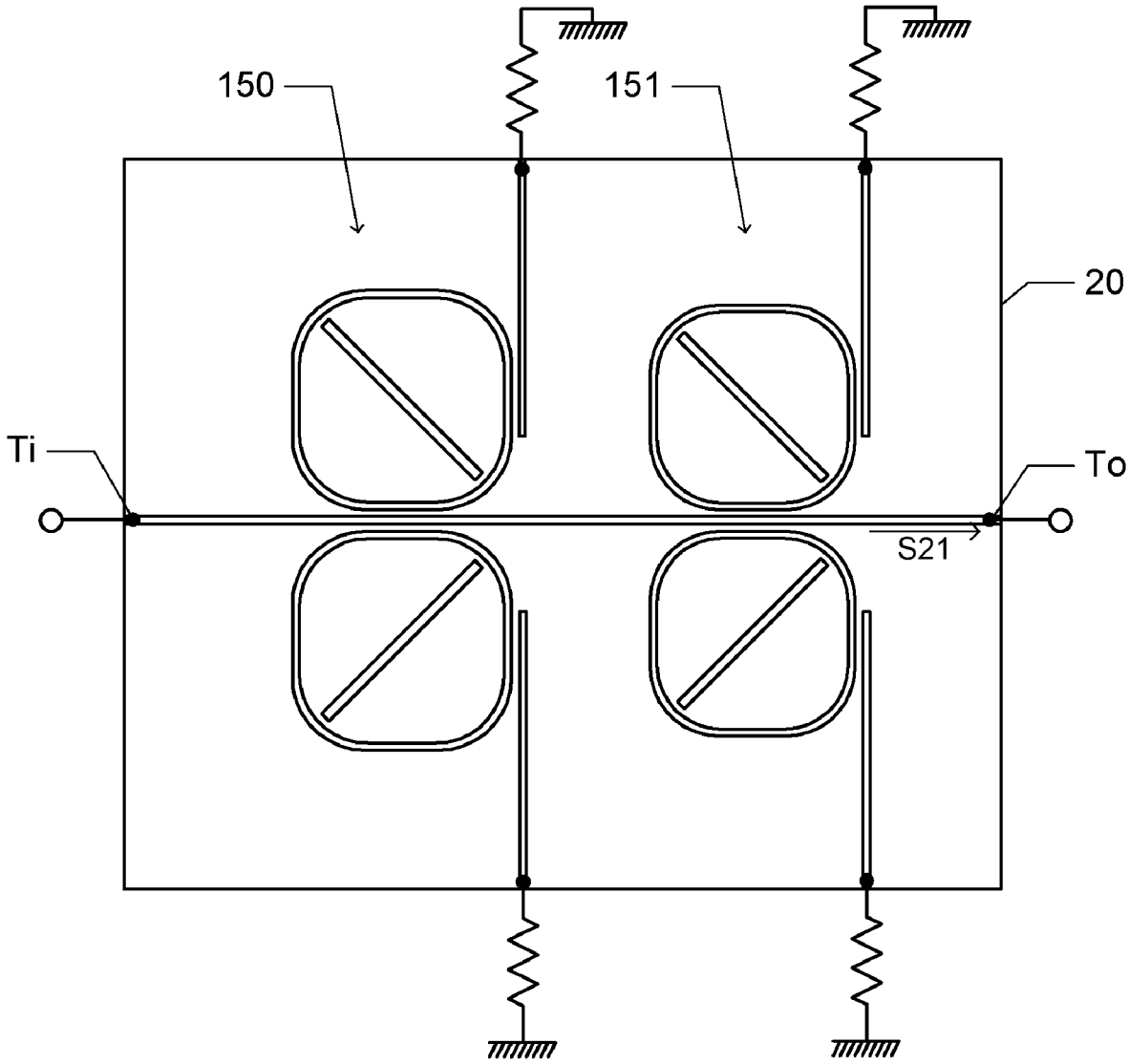
FIG. 15 is a plan view illustrating a main portion of a dual mode filter according to a tenth embodiment.

FIG. 15 illustrates conductive patterns on a dielectric substrate 20 of a dual mode filter according to the tenth embodiment. Element $S_{21}$ of S parameter is denoted in FIG. 15. The dual mode filter of the tenth embodiment includes an input terminal Ti and an output terminal To.

In the tenth embodiment, two dual mode filters 150 and 151 having the same patterns as those of the dual mode filter illustrated in FIG. 13 are disposed along a main transmission line 100. However, a line length of two ring resonators of the dual mode filter 151 at the second stage is different from that of two ring resonators of the dual mode filter 150 at the first stage. Namely, a resonance frequency $f_1$ of the dual mode filter 150 at the first stage is different from a resonance frequency $f_2$ of the dual mode filter 151 at the second stage.

Figure 16A:
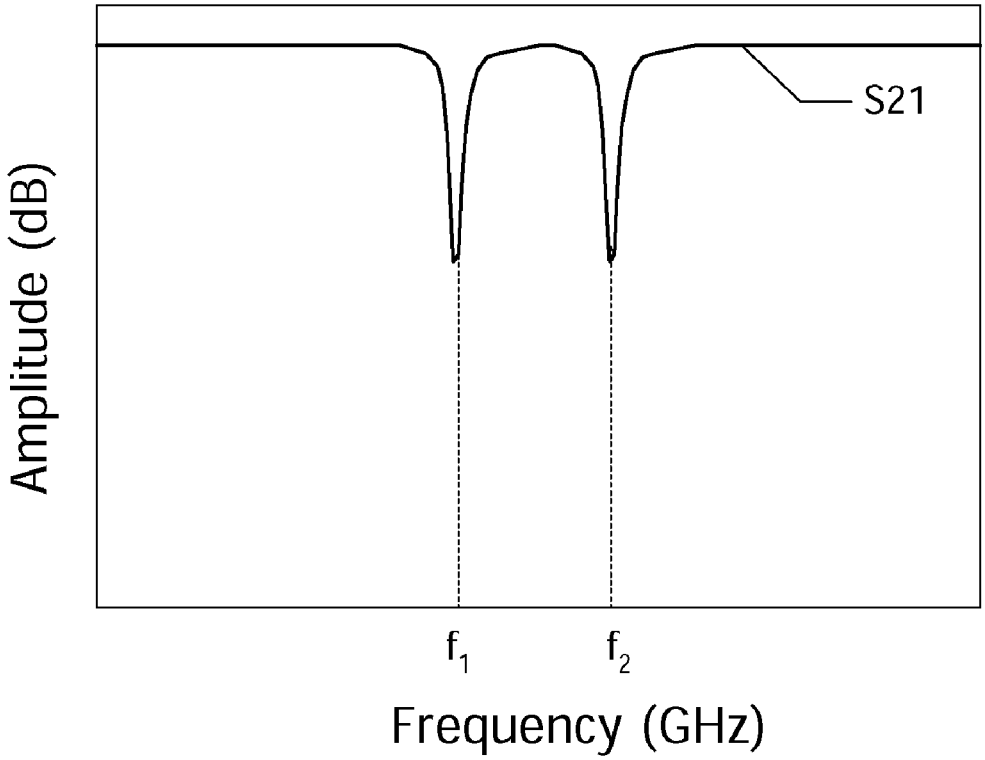
FIG. 16A is a graph illustrating transmission characteristics of the dual mode filter of the tenth embodiment.

FIG. 16A illustrates the transmission characteristics of a high frequency signal. The abscissa represents a frequency in the unit of "GHz", and the ordinate represents an Amplitude in the unit of "dB". Element $S_{21}$ of S parameter is depicted in FIG. 16A. A high frequency signal attenuates in a frequency range near the resonance frequency $f_1$ of the dual mode filter 150 at the first stage and in a frequency range near the resonance frequency $f_2$ of the dual mode filter 151 at the second stage as illustrated in FIG. 15.

Figure 16B:
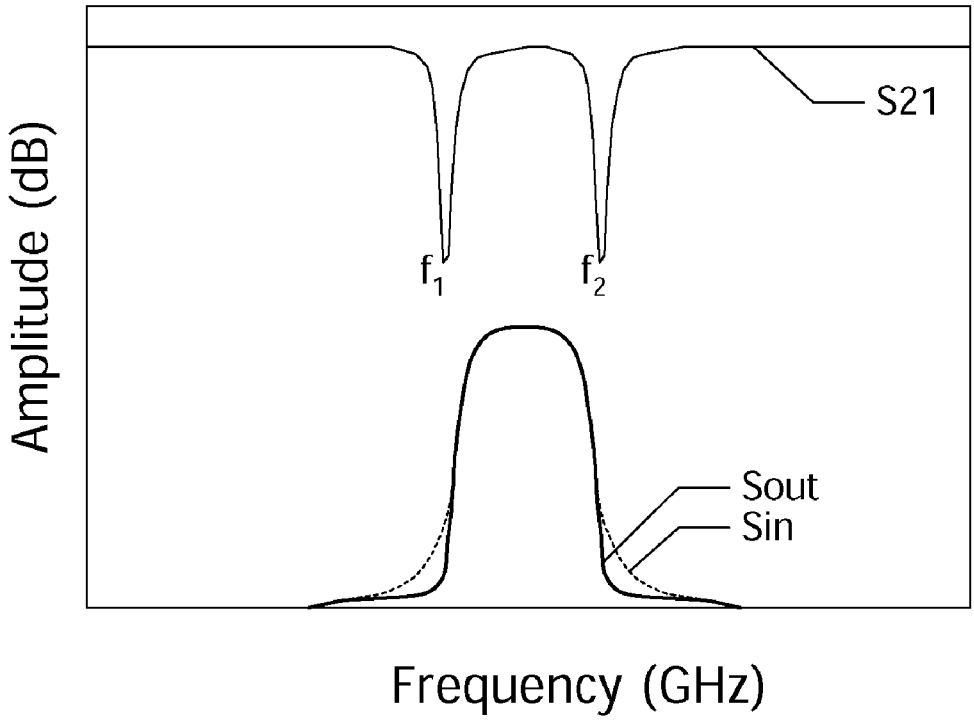
FIG. 16B is a graph illustrating spectra of input and output signals.

FIG. 16B illustrates a relation between spectra of an input signal and an output signal. The abscissa represents a frequency in the unit of "GHz", and the ordinate represents an Amplitude in the unit of "dB". Element $S_{21}$ of S parameter is depicted in FIG. 16B. A spectrum of the input signal Sin has a center frequency between the resonance frequencies $f_1$ and $f_2$, and has lower slope portions near the resonance frequencies $f_1$ and $f_2$. As the dual mode filter of the tenth embodiment illustrated in FIG. 15 is used, the input signal Sin is attenuated near the resonance frequencies $f_1$ and $f_2$ so that the lower slope portions of the input signal Sin are attenuated. Therefore, a spread width of the spectrum of the output signal Sout is narrower than that of the spectrum of the input signal Sin. It is therefore possible to suppress signal leak to an adjacent channel on a frequency axis.

If the dual mode filter of the first embodiment is used, almost all of a power of the input signal passes through the ring resonator 21. It is therefore necessary to increase power resistance of the ring resonator 21. In contrast, in the tenth embodiment, most of the input signal Sin propagates directly through the main transmission line 100 (FIG. 13) and reaches the output terminal To. A signal passing through the ring resonators of the dual mode filters 150 and 151 is only frequency components corresponding to the lower slope portions of the input signal Sin. A ring resonator having low-power resistance can therefore be used.

Eleventh Embodiment

Figure 17:
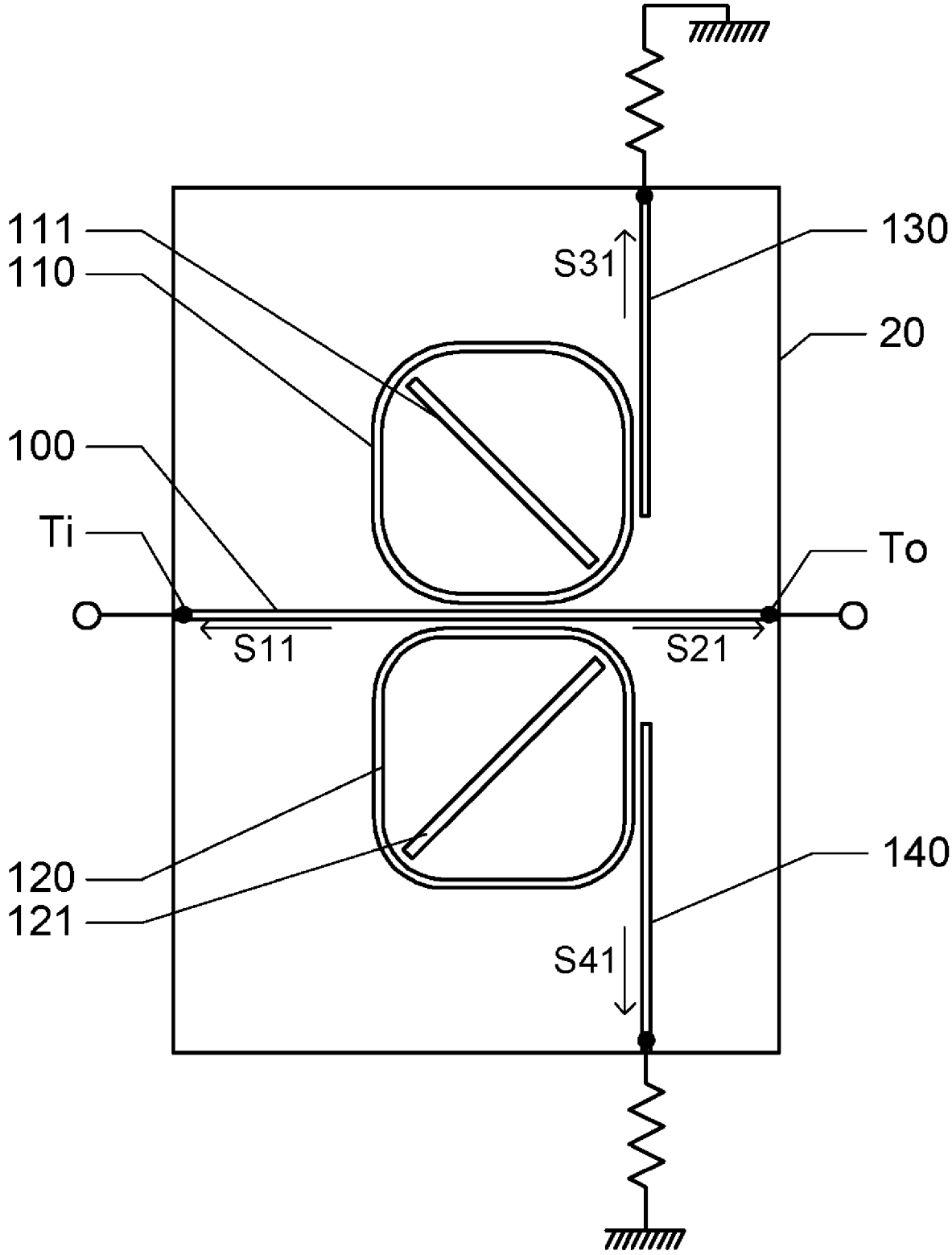
FIG. 17 is a plan view illustrating a main portion of a dual mode filter according to an eleventh embodiment.

FIG. 17 illustrates conductive patterns on a dielectric substrate 20 of a dual mode filter according to the eleventh embodiment. S11, S21, S31 and S41 correspond to S11, S21, S31 and S41 in FIG. 18, respectively. The dual mode filter of the eleventh embodiment includes a substrate 20, an input terminal Ti and an output terminal To.

In the ninth embodiment illustrated in FIG. 13, the first ring resonator 110 and second ring resonator 120 have line symmetrical planar shapes with each other and the same resonance frequency. In the eleventh embodiment, a transmission line length of a first ring resonator 110 is different from that of a second ring resonator 120. Resonance frequencies of both the ring resonators are therefore different from each other.

More specifically, a planar shape of the first ring resonator 110 is the same as the planar shape of the first ring resonator 110 of the dual mode filter of the ninth embodiment illustrated in FIG. 13. A radius of curvature of four corners of the second ring resonator 120 is smaller than that of four corners of the first ring resonator 110. A distance between opposing straight line portions of the second ring resonator 120 is equal to that of the first ring resonator 110. A transmission line length of the second ring resonator 120 is therefore longer than that of the first ring resonator 110.

A coupling intensity between the main transmission line 100 and second ring resonator 120 is nearly equal to that between the main transmission line 100 and first ring resonator 110. Further, a coupling intensity between a second subsidiary transmission line 140 and second ring resonator 120 is nearly equal to that between a first subsidiary transmission line 130 and first ring resonator 110.

It is designed so that a gap between each end of a second dual mode generating line 121 and the second ring resonator 120 is equal to a gap between each end of a first dual mode generating line 111 and the first ring resonator 110. Therefore, the second dual mode generating line 121 is longer than the first dual mode generating line 111.

Frequency components near the resonance frequency of the first ring resonator 110 propagate to the first subsidiary transmission line 130, and frequency components near the resonance frequency of the second ring resonator 120 propagate to the second subsidiary transmission line 140.

Figure 18:
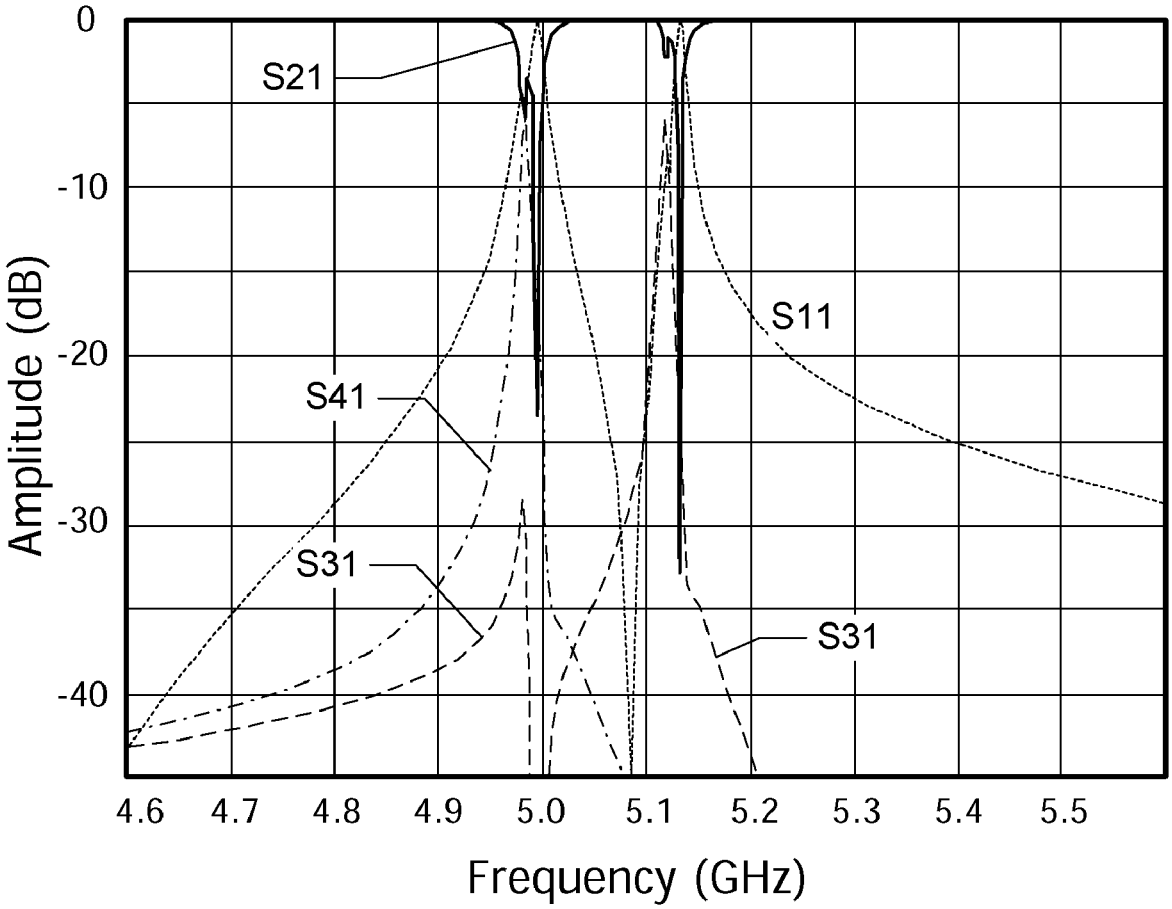
FIG. 18 is a graph illustrating the filter characteristics of the dual mode filter of the eleventh embodiment.

FIG. 18 illustrates simulation results of spectra of signals propagating respective transmission lines. The abscissa represents a frequency in the unit of "GHz", and the ordinate represents an Amplitude in the unit of "dB". A solid line S21 drawn in FIG. 18 indicates amplitude of a signal output to an output terminal To (FIG. 17), and a dotted line S11 indicates amplitude of a reflected wave returning to an input terminal Ti (FIG. 17). A broken line S31 and a one-dot chain line S41 indicate amplitudes of signals output to output terminals of the first subsidiary transmission line 130 (FIG. 17) and second subsidiary transmission line 140 (FIG. 17), respectively.

The transmission characteristics S21 appear similar to the transmission characteristics illustrated in FIG. 16A, and a high frequency signal is attenuated in a frequency range near the resonance frequency of the first ring resonator 110 and in a frequency range near the resonance frequency of the second ring resonator 120.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A dual mode filter comprising:

a ring resonator having a ring-shaped transmission line;

an input feeder electromagnetically coupled with the ring resonator at a first coupling point on the ring resonator;

an output feeder electromagnetically coupled with the ring resonator at a second coupling point on the ring resonator different from the first coupling point; and a dual mode generating line disposed in an inner area of the ring resonator, one end of the dual mode generating line electromagnetically coupled with the ring resonator at a third coupling point on the ring resonator, and the other end thereof electromagnetically coupled with the ring resonator at a fourth coupling point on the ring resonator distant from the third coupling point by substantially half of a transmission line length of the ring resonator.

2. The dual mode filter according to claim 1, wherein a transmission line length of the ring resonator from the first coupling point to the second coupling point is substantially quarter of the line length of the ring resonator.

3. The dual mode filter according to claim 1, wherein a transmission line length of the ring resonator from the first coupling point to the second coupling point is substantially ⅛ or substantially ⅜ of the transmission line length of the ring resonator.

4. The dual mode filter according to claim 1, wherein the third coupling point is positioned at a middle point of a transmission line having as both ends the first and second coupling points, or at a point to which a transmission line length from the middle point is equal to or shorter than 1.4% of the transmission line length of the ring resonator.

5. The dual mode filter according to claim 1, wherein the third coupling point is positioned at a first point distant from a middle point of a transmission line having as both ends the first and second coupling points, by quarter of the transmission line length of the ring resonator, or at a point to which a transmission line length from the first point is equal to or shorter than 1.4% of the transmission line length of the ring resonator.

6. The dual mode filter according to claim 1, further comprising a capacitance adjusting member for changing at least one of a coupling capacitance between the ring resonator and the dual mode generating line at the third coupling point, and a coupling capacitance between the ring resonator and the dual mode generating line at the fourth coupling point.

7. The dual mode filter according to claim 1, further comprising:

a dielectric substrate having first and second surfaces; and a ground film disposed on the first surface of the dielectric substrate, wherein the ring resonator, the input feeder, the output feeder, and the dual mode generating line include conductive patterns disposed on the second surface of the dielectric substrate.

* * * * *